US011753216B2

(12) United States Patent
Schmidt et al.

(10) Patent No.: US 11,753,216 B2
(45) Date of Patent: Sep. 12, 2023

(54) CLOSURE

(71) Applicant: Obrist Closures Switzerland GmbH, Reinach (CH)

(72) Inventors: Patrick Schmidt, Zell-Kaimt (DE); Rainer Schawo, Zell (DE)

(73) Assignee: Obrist Closures Switzerland GmbH, Reinach (CH)

( * ) Notice: Subject to any disclaimer, the term of this patent is extended or adjusted under 35 U.S.C. 154(b) by 96 days.

(21) Appl. No.: 17/612,802

(22) PCT Filed: May 23, 2020

(86) PCT No.: PCT/EP2020/064343

§ 371 (c)(1),
(2) Date: Nov. 19, 2021

(87) PCT Pub. No.: WO2020/239643

PCT Pub. Date: Dec. 3, 2020

(65) Prior Publication Data

US 2022/0250810 A1 Aug. 11, 2022

(30) Foreign Application Priority Data

May 26, 2019 (GB) ..... 1907442
Oct. 29, 2019 (GB) ..... 1915647
Nov. 22, 2019 (GB) ..... 1917080

(51) Int. Cl.
*B65D 47/08* (2006.01)
*B65D 50/06* (2006.01)

(52) U.S. Cl.
CPC ..... *B65D 47/0814* (2013.01); *B65D 50/066* (2013.01); *B65D 2401/15* (2020.05)

(58) Field of Classification Search
CPC ..... B65D 47/0814; B65D 50/066; B65D 2401/15
(Continued)

(56) References Cited

U.S. PATENT DOCUMENTS 768,950 A * 8/1904 Purdy ..... B65D 47/0814 215/237
792,841 A * 6/1905 Nolte ..... B65D 47/0814 215/237
(Continued)

FOREIGN PATENT DOCUMENTS

WO 2009145847 A1 12/2009
WO 2011129798 A1 10/2011
(Continued)

OTHER PUBLICATIONS

Sep. 10, 2020—(WO) International Search Report and Written Opinion—Appl. No. PCT/EP2020/064343, 11 pages.
(Continued)

*Primary Examiner* — Paul R Durand
*Assistant Examiner* — Michael J. Melaragno
(74) *Attorney, Agent, or Firm* — Banner & Witcoff, Ltd.

(57) ABSTRACT

A dispensing closure is provided and comprises a base and a lid. The base includes a sidewall closed at one end by a top deck including a dispensing orifice. The base and lid are joined by a hinge to allow the lid to move between closed and open positions with respect to the base whereby to close and open the dispensing orifice. At the periphery of the top deck the sidewall forms or provides a raised lip. The lid closes onto the top deck and is bounded by the lip and the lid is generally flush with the lip when in the closed position.

20 Claims, 24 Drawing Sheets

310

(58) Field of Classification Search
USPC ..... 222/153.14
See application file for complete search history.

(56) References Cited

U.S. PATENT DOCUMENTS

| | | | | | |
|---|---|---|---|---|---|
| 818,798 | A * | 4/1906 | Taylor | B65D 47/0814 | 215/235 |
| 4,106,672 | A | 8/1978 | Tecco et al. | | |
| 4,487,324 | A * | 12/1984 | Ostrowsky | B65D 47/0814 | 215/253 |
| 4,787,525 | A * | 11/1988 | Joyce | B65D 47/0838 | 215/237 |
| 4,993,606 | A * | 2/1991 | Bolen, Jr. | B65D 47/0885 | 222/546 |
| 5,361,920 | A * | 11/1994 | Nozawa | B65D 47/0814 | 220/838 |
| 5,423,442 | A * | 6/1995 | Nozawa | B65D 47/0814 | 220/838 |
| 5,437,383 | A * | 8/1995 | Stull | B65D 47/0814 | 220/834 |
| 5,489,035 | A * | 2/1996 | Fuchs | B65D 47/0814 | 215/237 |
| 5,540,343 | A * | 7/1996 | Schumacher | B65D 47/0814 | 220/838 |
| 5,850,953 | A * | 12/1998 | Dallas, Jr. | B65D 47/40 | 222/111 |
| 6,454,130 | B1 * | 9/2002 | Miller | B65D 47/0814 | 222/94 |
| 6,766,926 | B1 * | 7/2004 | Elchert | B65D 51/20 | 222/546 |
| 7,717,281 | B2 * | 5/2010 | Baudin | B65D 47/0814 | 215/354 |
| 2005/0023285 | A1 * | 2/2005 | Keung | B65D 47/0804 | 215/237 |
| 2005/0173366 | A1 * | 8/2005 | Baudin | B65D 47/0814 | 220/837 |
| 2006/0011573 | A1 * | 1/2006 | Herald | B65D 55/024 | 215/237 |
| 2006/0043052 | A1 * | 3/2006 | Lin | B65D 47/0838 | 215/253 |
| 2006/0086757 | A1 * | 4/2006 | Robinson | B65D 50/046 | 222/153.14 |
| 2006/0186079 | A1 * | 8/2006 | Ziegenhorn | B65D 47/0809 | 222/153.07 |
| 2006/0201976 | A1 * | 9/2006 | Bloom | B65D 47/2031 | 222/494 |
| 2007/0205177 | A1 * | 9/2007 | Delage | B65D 47/0814 | 215/235 |
| 2007/0267451 | A1 | 11/2007 | Robinson | | |
| 2008/0237236 | A1 * | 10/2008 | Tanner | B65D 50/046 | 220/320 |
| 2008/0245795 | A1 * | 10/2008 | Berge | B65D 47/0814 | 220/780 |
| 2008/0264961 | A1 * | 10/2008 | Sawyer | B65D 47/0814 | 215/316 |
| 2009/0236339 | A1 * | 9/2009 | Blomdahl | B65D 47/0804 | 220/254.1 |
| 2010/0127021 | A1 * | 5/2010 | Schantz | B65D 47/0838 | 222/498 |
| 2013/0220967 | A1 * | 8/2013 | Wang | B65D 47/0838 | 215/253 |
| 2019/0193902 | A1 * | 6/2019 | Aubret | B65D 47/0814 | |
| 2021/0147123 | A1 * | 5/2021 | Stadelmaier | B65D 47/0814 | |
| 2022/0153485 | A1 * | 5/2022 | Stadelmaier | B65D 41/023 | |
| 2022/0250810 | A1 * | 8/2022 | Schmidt | B65D 50/066 | |
| 2023/0017507 | A1 * | 1/2023 | Athay | B65D 55/024 | |

FOREIGN PATENT DOCUMENTS

| | | | | |
|---|---|---|---|---|
| WO | WO-2012118502 | A1 * | 9/2012 | B65D 47/0804 |
| WO | WO-2020239643 | A1 * | 12/2020 | B65D 47/0809 |
| WO | WO-2021099968 | A1 * | 5/2021 | B65D 47/0814 |
| WO | WO-2021111367 | A1 * | 6/2021 | B65D 47/0838 |

OTHER PUBLICATIONS

Aug. 25, 2021—(WO) International Preliminary Report on Patentability—Appl. No. PCT/EP2020/064343, 9 pages.

* cited by examiner

310

310

310

310

CLOSURE

CROSS-REFERENCE TO RELATED APPLICATIONS

This application is a U.S. National Stage application under 35 U.S.C. § 371 of International Application PCT/EP2020/064343 (published as WO 2020/239643), filed May 23, 2020, which claims the benefit of priority to U.K. Application No. 1907442.6, filed May 26, 2019, U.K. Application No 1915647.0 filed Oct. 29, 2019, and U.K. Application No. 1917080.2, filed Nov. 22, 2019. Each of these prior applications is hereby incorporated by reference in its entirety.

The present invention relates generally to a closure and particularly, although not exclusively, to a tube closure.

An aspect of the present invention provides a dispensing closure comprising a base and a lid, the base includes a sidewall closed at one end by a top deck including a dispensing orifice, the base and lid being joined by a hinge to allow the lid to move between closed and open positions with respect to the base whereby to close and open the dispensing orifice, at the periphery of the top deck the sidewall forms or provides at least part of a raised lip, in which the lid closes onto the top deck and is bounded by the lip and in which the lid is generally flush with the lip when in the closed position.

The top deck may be dished.

The lip may be formed at the intersection between the sidewall and the top deck.

The sidewall lip may comprise two arc portions separated at a front of the closure by a lifting recess and at the back of the closure by a hinge recess.

The closure may comprise a lock for preventing the lid being moved away from the closed position.

The closure may comprise a movable locking portion movable from a locked to an unlocked position.

The locking portion may comprise a flap or panel.

The movable locking portion may be provided on or by the base.

A further aspect provides closure comprising a base and a lid, the base and lid being joined by a hinge, the base includes a sidewall, the sidewall defines an uppermost axial level, and in which the lid is generally flush with the axial level whereby the lid is recessed into the base.

The sidewall may include a lifting recess which exposes part of the lid, for example the underside of the lid and or a peak, to assist with lifting.

The lifting recess may be generally opposite the hinge, for example diametrically opposite.

In some embodiments the periphery of the lid is inboard of the sidewall; in other words, for example, part of the sidewall may extend around part of the lid.

In some embodiment the lid (or at least an upper face thereof) may be generally flat.

The hinge may, for example, be a butterfly hinge.

The skirt may be generally cylindrical. The section of the skirt may, for example, be generally circular or generally oval.

The base may comprise a top deck. The deck may have a dispensing orifice, for example a generally centrally positioned through hole.

In some embodiments the deck may be concave/dished, which may help to receive the lid.

The lid may have an overhang (such as a peak) for allowing/helping it to be lifted.

The base may be engageable on a container/tube neck using screw threads or using snap fit engagement means (such as a snap bead). In some embodiments the closure may be removeable; in others in may be non-removable.

In some embodiments the closure may further comprise a lock for preventing the lid from being lifted.

In some embodiments the lock may be configured as a transport lock.

In some embodiments a bi-stable nose/beak may be provided and can flip from or between a locked to/and an unlocked position.

In some embodiments a bi-stable locking portion may be movable between a locked position in which lid cannot be moved to an open position and an unlocked position in which the lid can be moved to an open position. In other embodiments the locking portion is provided in a locked position and irreversibly movable to an unlocked position.

The locking portion may be provided on or by the base; in other embodiments the locking portion is provided on or by the lid. Corresponding locking means may be provided on the other of the base and lid.

A further aspect provides a flip-top dispensing closure for a tube, the closure comprising a base and a top plate, the base and plate being joined by a hinge to allow the plate to move between closed and open positions with respect to the base, the base comprises a side wall closed at one end by a top deck, the top deck, together with the side wall, forms a seat for the top plate such that when the top plate is in the closed position it is flush fitting within the skirt.

A further aspect provides a dispensing closure comprising a base and a lid, the base includes a sidewall closed at one end by a top deck including a dispensing orifice, the base and lid being joined by a hinge to allow the lid to move between closed and open positions with respect to the base and to close and open the dispensing orifice, at the periphery of the top deck the sidewall provides a raised lip, in which the lid closes onto the top deck and is bounded by the lip and in which the lid is generally flush with the lip.

A sidewall lip/ridge/upstand may comprise two arc portions separated at a front of the closure by a lifting recess and/or at the back of the closure by a hinge recess.

The closure may comprise a lock for preventing the lid being moved away from the closed position.

The closure may comprise a movable locking portion movable from a locked to an unlocked position.

The locking portion may comprise a flap or panel.

The movable locking portion may be provided on or by the base and/or on or by the lid.

A further aspect provides a closure, the closure comprising a base and a top plate, the base and plate being joined by a hinge to allow the plate to move between closed and open positions with respect to the base, in the closed position the top plate is embedded within the skirt.

A further aspect provides a closure, the closure comprising a base and a top plate, the base and plate being joined by a hinge to allow the plate to move between closed and open positions with respect to the base, the base is closed at one end by a top deck, the top deck is dished whereby to form a recess for receiving the lid.

In the closed position the top plate may be generally flush with the periphery of the top plate and/or the top of the sidewall and/or the intersection between the sidewall and the top plate.

In the closed position the top plate may be sunken with respect to the periphery of the top plate and/or the top of the sidewall and/or the intersection between the sidewall and the top plate.

In plan the shape of the top plate may be generally: circular; square; curved rectangle; squircle; oval; irregular oval; flattened sided oval; super-elliptical; rectellipse.

In some aspects and embodiments a lid/bottle cap may comprising a first portion, the first portion being extended eccentrically in a first direction/axis. This could include, for example, regular ellipse/super ellipse shapes but also more irregular shapes.

In one embodiment the top plate has a plan shape which is generally that of a superellipse.

In some aspects and embodiments the closure may be a dispensing closure.

The closure may comprise a base and a lid.

The closure may be a flip-top dispensing closure.

The base and lid may be connected by a hinge, for example a butterfly hinge.

The lid may be a top plate.

The base may have a skirt. The lid/top plate may be recessed/sunken/embedded in the skirt. The plate may be flush with the top of the skirt.

The skirt may, for example, be generally cylindrical with a generally circular or generally oval section.

The top plate may, for example, be generally flat.

In some embodiments an upper surface of the top plate is generally planar.

The base may comprise a top deck. The deck may have a dispensing orifice. The deck may be dished/concave for receiving the lid.

The skirt may have a notch to allow access to the sunken top plate. The notch may be generally opposite a hinge.

The top plate may have a peak/beak/overhang for allow it to be lifted.

The base may be engaged or engageable on a container/tube neck, for example by screw threads or snap fitting.

Some aspects/embodiments of the closure may exhibit some advantages, namely:

- E-commerce: due to the (within the skirt) embedded top plate, the closure will not open if dropped accidently/falls down since all energy will be absorbed by the side skirt;
- High customer satisfaction: due to a very ergonomic and smooth hollow around the opening, consumer can wipe the cream easily off, for example;
- top plate could be manufactured via 2K, e.g. sequential moulding;
- one of the drawings shows the top plate in a different colour as an example;
- some embodiments are 10% lighter in material compared to average closures of similar design.

Some embodiments, for example, relate to a 50 mm diameter closure, for example with a presser.

50 mm HTCE-Prell

Closures may, for example be useful for E-commerce, especially with a transport lock to prevent inadvertent opening of a lid.

The closure may be formed as a tube closure

The present invention also provides a closure as described herein in combination with a container.

The container may be a tube, for example a squeezable tube. In some embodiments the tube contains cosmetics or the like.

The present invention also provides a closure as described herein in combination with a tube, for example for cosmetics and the like.

The present invention may relate generally to a closure and particularly, although not exclusively, to a tube closure.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

Referring first to FIGS. 1 to 10 there is shown a dispensing closure generally indicated 10.

The closure 10 comprises a base 15 and a lid 20.

The base 15 and lid 20 are joined by a hinge 25 which allows the lid 20 to move between a closed position (FIGS. 1 and 2: 1 (front perspective); 2 (rear perspective)) and an open position (FIGS. 3 to 10: 3 (plan view); 4 (side); 5 (underplan); 6 (rear perspective); 7 (rear); 8 (front perspective); 9 (bottom perspective); 10 (section)).

The base 15 comprises a generally cylindrical sidewall 30 with a generally circular section. At one end of the sidewall is a generally circular top deck/wall/plate 35. The top deck 35 has a central (in this embodiment) dispensing orifice 40.

It will be noted that the top deck 35 is dished/concave, which means that the intersection between the periphery of the top deck 35 and the sidewall 30 is "taller" i.e. axially extended with respect to the centre of the top deck. This means that in some respects the top deck is sunken with respect to the sidewall. This configuration effectively forms a shallow recess 37.

The underside of the top deck 35 is provided with a depending outer annular skirt 36 which includes a segmented snap bead 38 for engaging a corresponding bead on a container neck (not shown). A plurality of axial anti-rotation ribs 39 extend radially inwards from the interior surface of the skirt 36 and in use can engage corresponding projections on a container neck to prevent relative rotation therebetween. Radially inwards of the skirt 36 a further, inner annular sealing skirt 41 depends from the underside of the top deck and in use would fit inside the bore of a container neck. Radially inwards of the skirt 41 an L-section orifice skirt 43 depends from the top plate around the orifice 40.

At the "front" of the base, opposite the point of attachment of the hinge, the sidewall is lowered to form a curved notch 50.

At the "back" of the base, a hinge notch 45 is provided. In this embodiment the hinge 25 is a "butterfly" type hinge and has two opposed lateral trapezoidal links/straps 26, 27 and a central main hinge portion 28.

At one end the hinge straps 26, 27 and portion 28 connects to the base in the hinge notch (i.e. beneath the axial height of the sidewall ridges); at the other end the hinge connects to an arcuate portion 21 at the rear of the lid 20. It will be seen that when the lid is closed the portion 21 therefore sits in the hinge notch 45. It will also be seen (e.g. FIGS. 4 and 7) that in the open position the lid sits below the height of the ridges 32, 34.

The notches 45, 50 mean that the top of the sidewall provides two arcuate raised regions/ridges/lips 32, 34.

The lid 20 closes onto the base, but it is not circular and does not close onto the top of the base. Instead, the lid has a generally rectilliptical shape. This means that the two lateral sides 22, 24 of the lid are generally parallel with (and radially inwards of) the ridges 32, 34 respectively. In this embodiment the sides 22, 24 extend/depend downwards. In addition, because of the position of the hinge and the hinge notch 45 the lid does not extend above the ridges 32, 34, but rather the lid can close into the recess formed by the dished top deck such that it is flush with the ridges.

The underside of the lid is provided with a spigot 23 which enters the dispensing orifice 40 when the lid is closed.

At the front of the lid (opposite the hinge) a depending peak 29 is provided. In the closed position the peak 29 sits in/above the notch 50. This allows a user to insert a finger and lift up the lid.

FIG. 11 shows a closure 110 formed according to a further embodiment. The closure 110 is similar to the closure 10, except that the closure is formed using a bi-injection moulding process meaning that the lid 120 can be formed in a different material and/or colour to the base 115.

FIGS. 12 to 14 show a closure 210 formed according to a further embodiment. The closure 210 is similar to the closures 10, 110. The closure 210 is shown attached to a tube 260.

FIGS. 15 to 37 show a closure 310 formed according to a further embodiment.

In FIGS. 15 to 18 show the closure in an initially closed, unopened condition.

The closure is similar to the closures 10, 110, 210 inasmuch as an embedded, flush fitting lid is provided. In this embodiment a lid lock is provided. This can be used, for example to help prevent the flip top from opening during transport.

The closure 310 has a frontal, curved notch 350. Within the notch is provided a flap/panel/beak 370.

Figure 19:
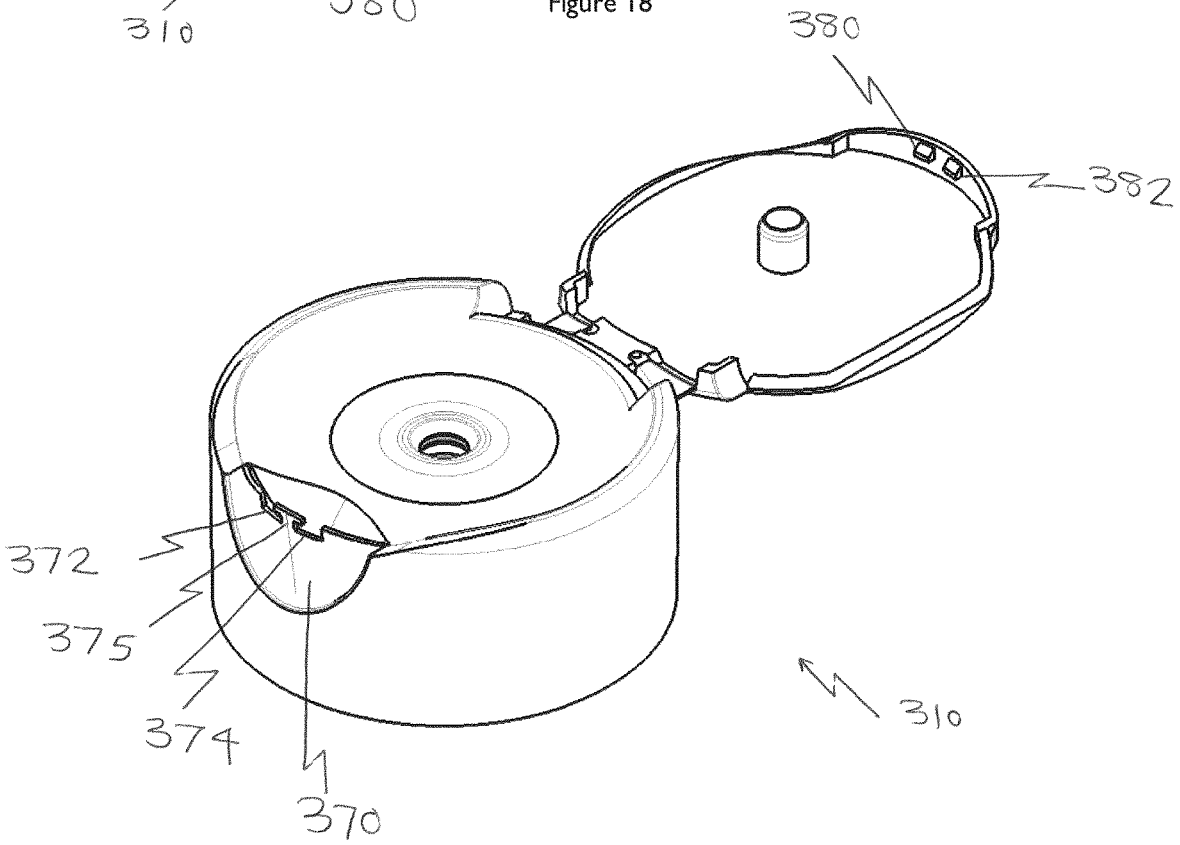
FIGS. 19 to 26 show the closure 310 is as as-formed (e.g. as moulded), condition, which in this embodiment is with the lid in an open position.
Figure 22:
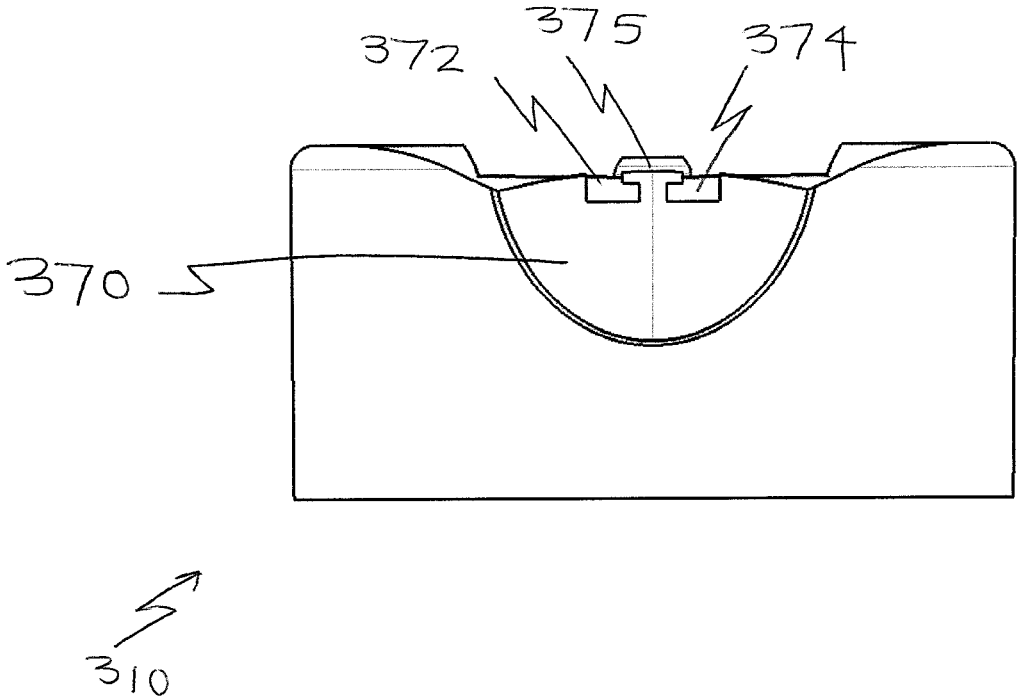
Figure 23:
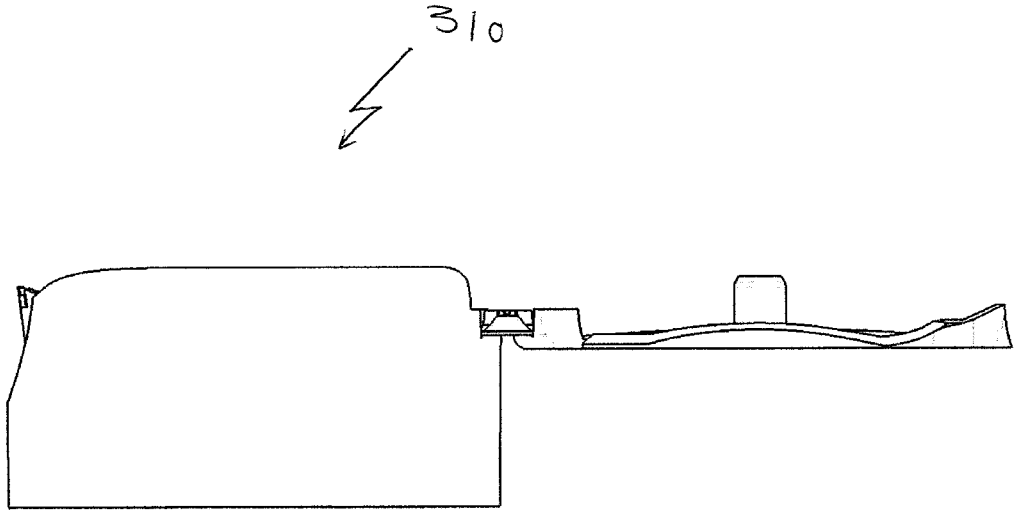
Figure 24:
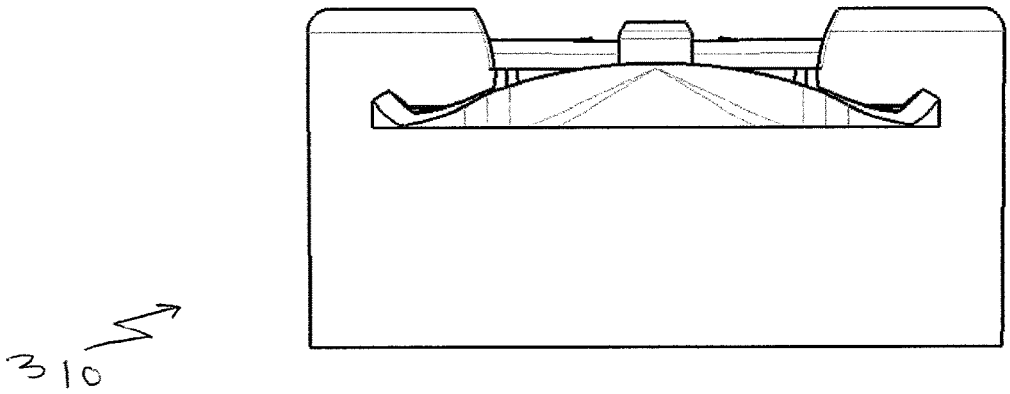
Figure 25:
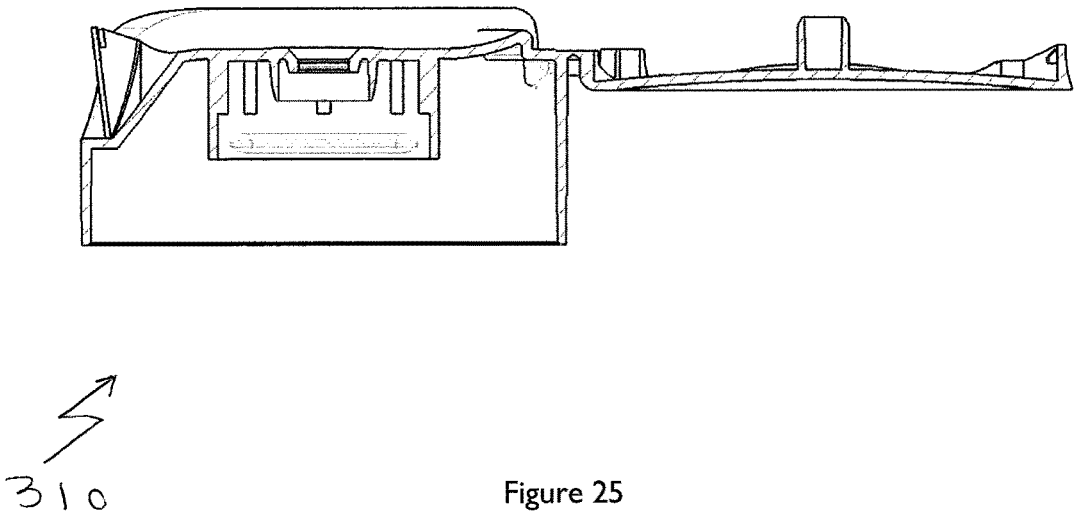
Figure 26:
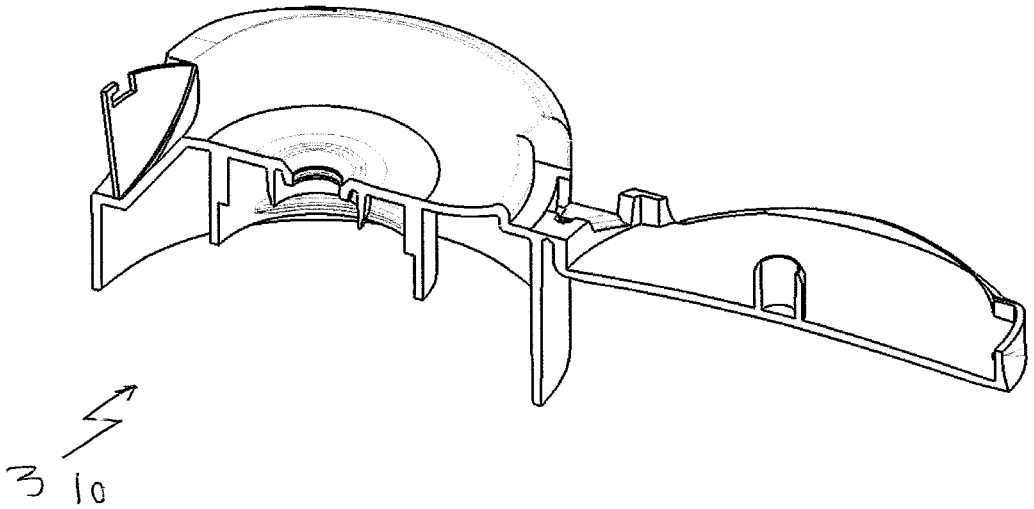

As shown best in FIGS. 19 and 22, at the top of the panel 370 two locking notches 372, 374 are provided and separated by a generally T-shape central post 375.

In the as-moulded and initially closed position the panel 370 is in a locking position, in which it bows/curves outwards (generally concave).

Figure 20:
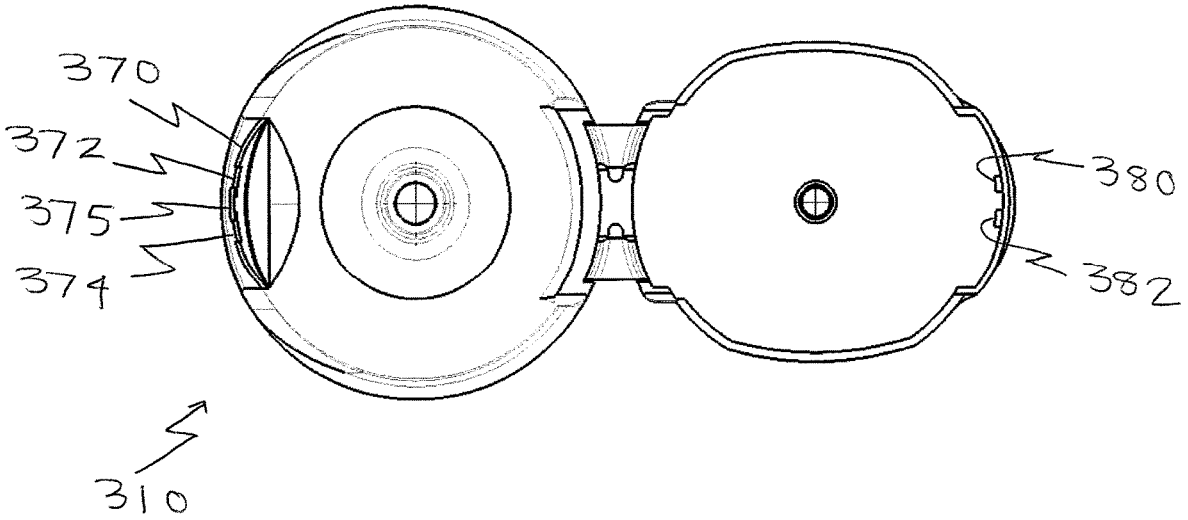
Figure 21:
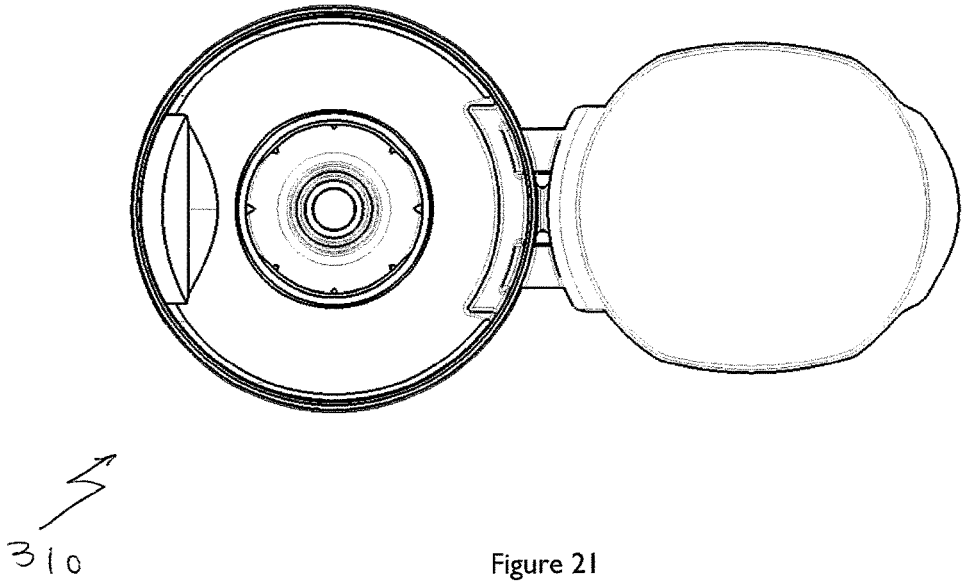

The lid 320 includes a frontal peak 329. The inner surface of the peak 329 is provided with two inwardly directed projections/lugs/pips 380, 382 as shown best in FIGS. 19 and 20.

Figure 1:
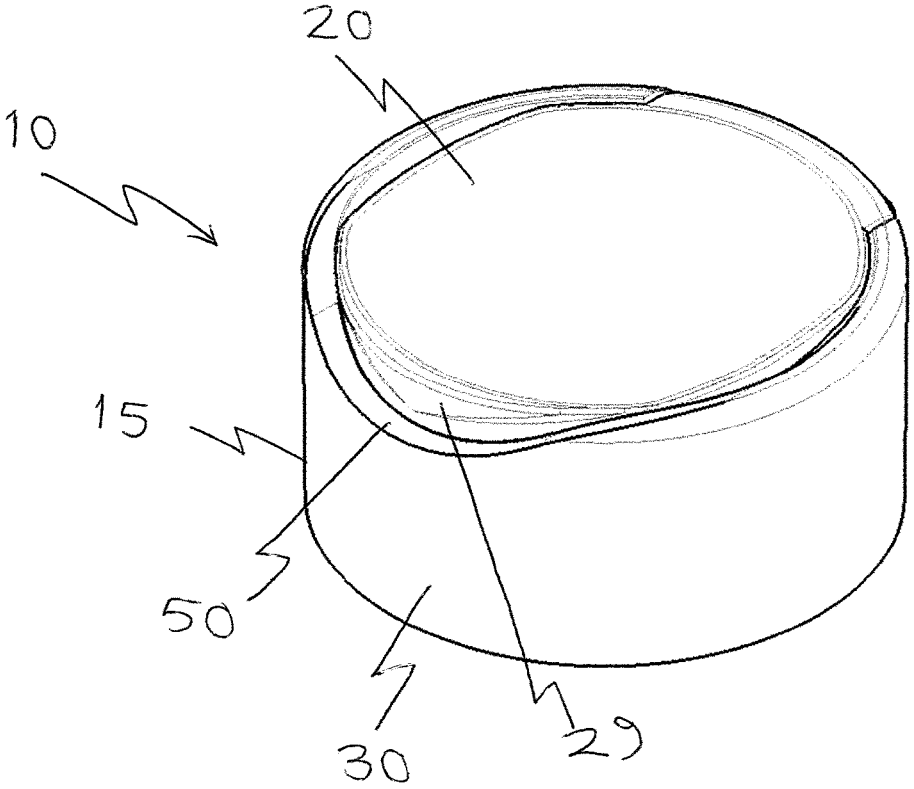
Figure 2:
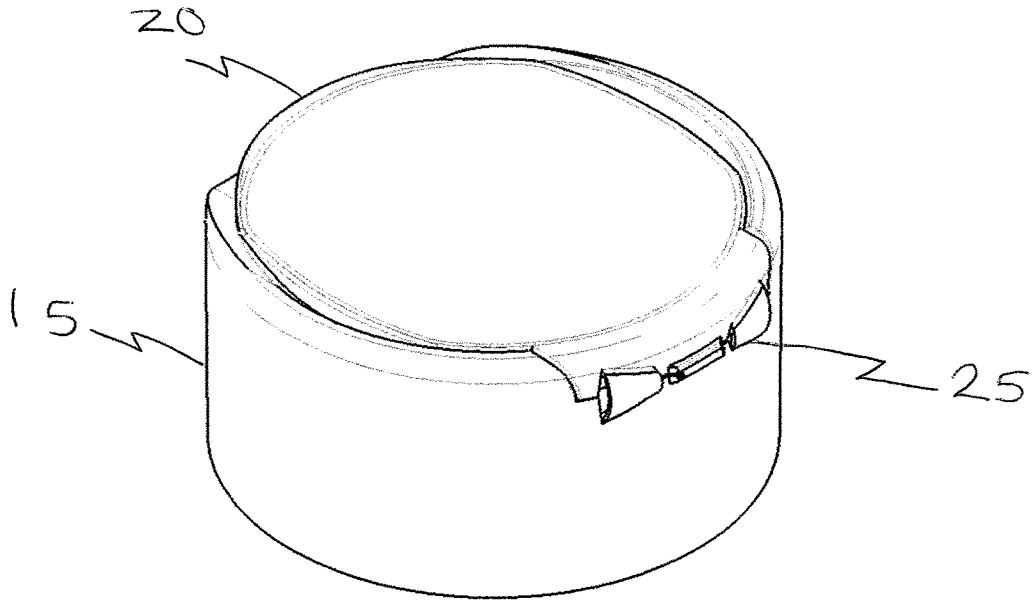
Figure 3:
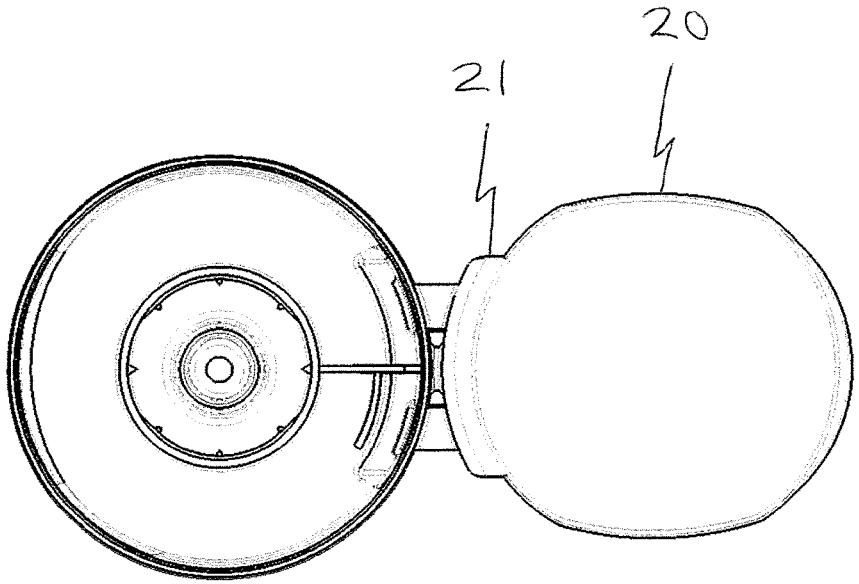
Figure 4:
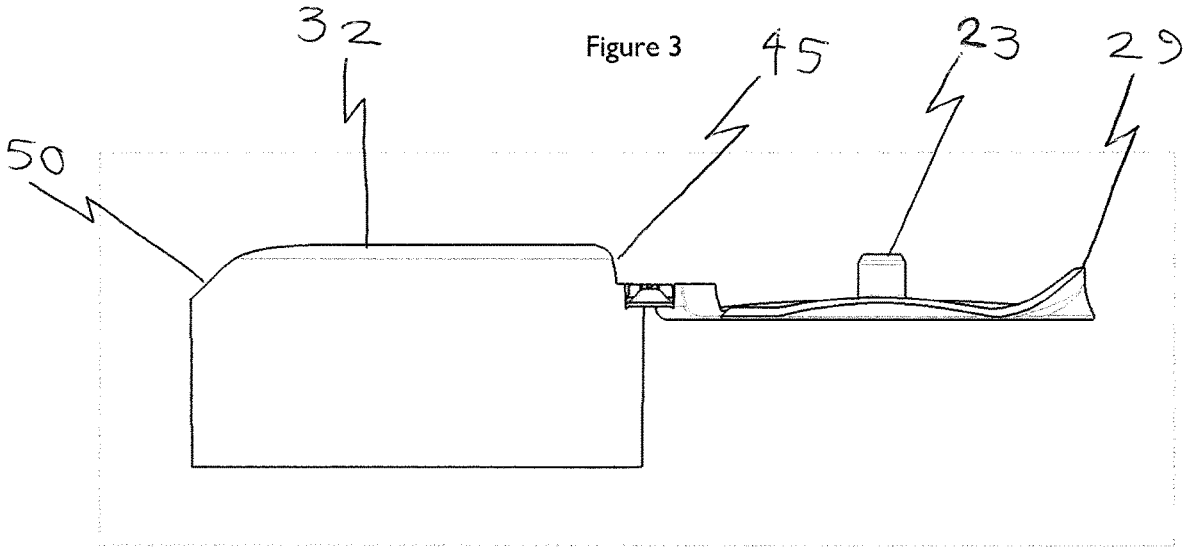
Figure 5:
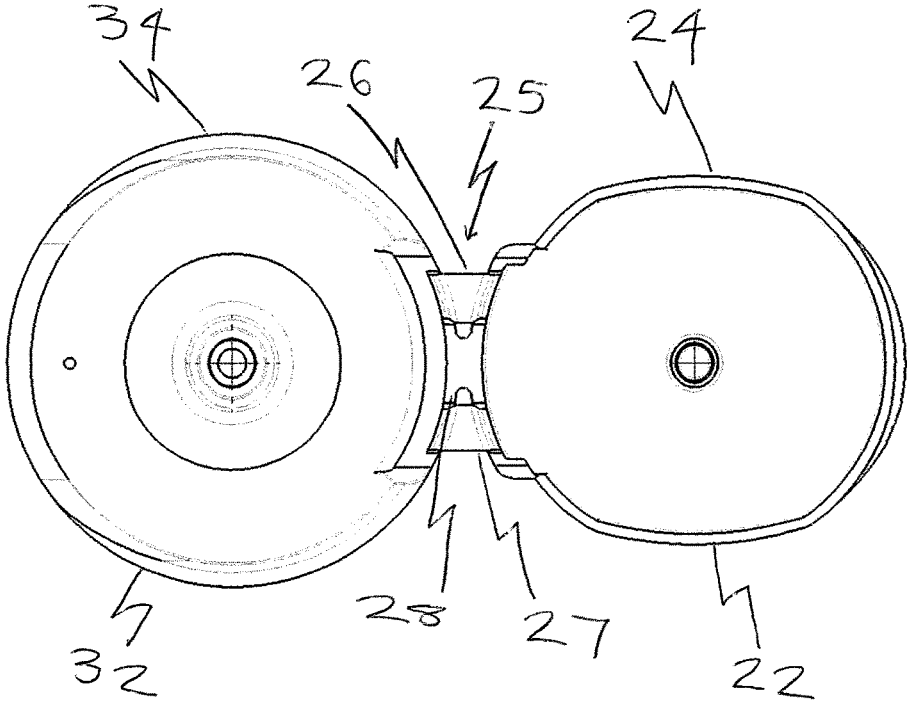
Figure 6:
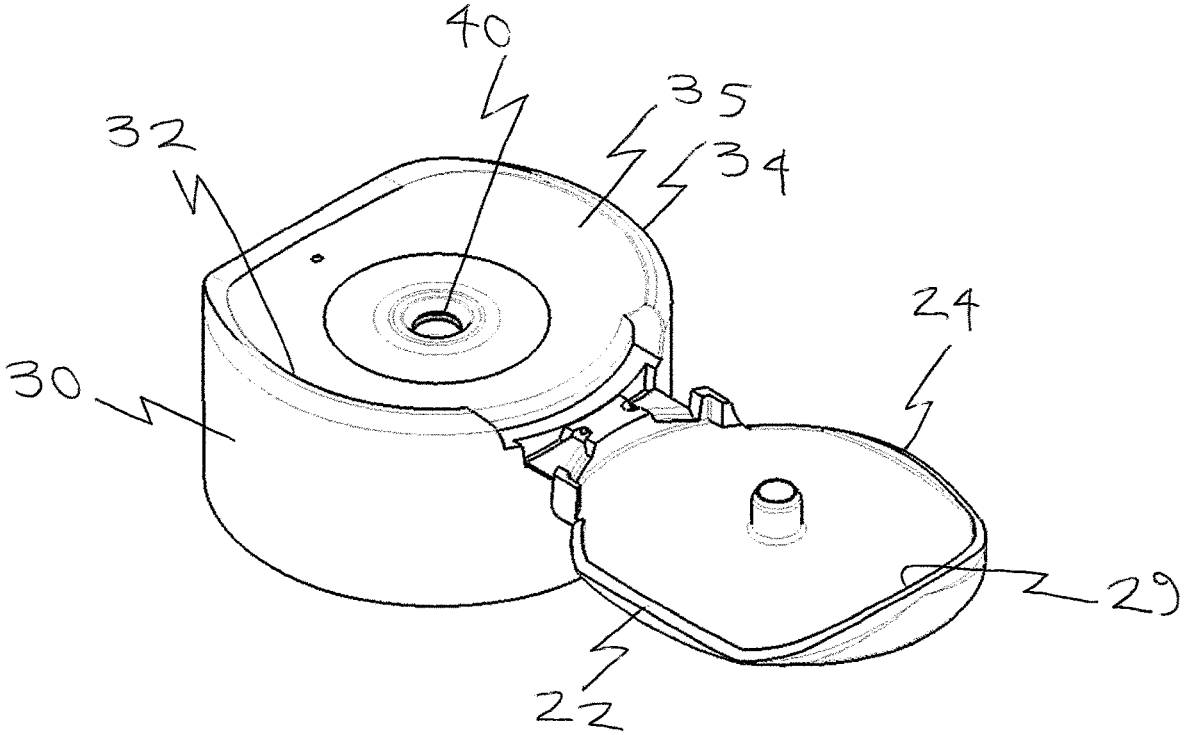
Figure 7:
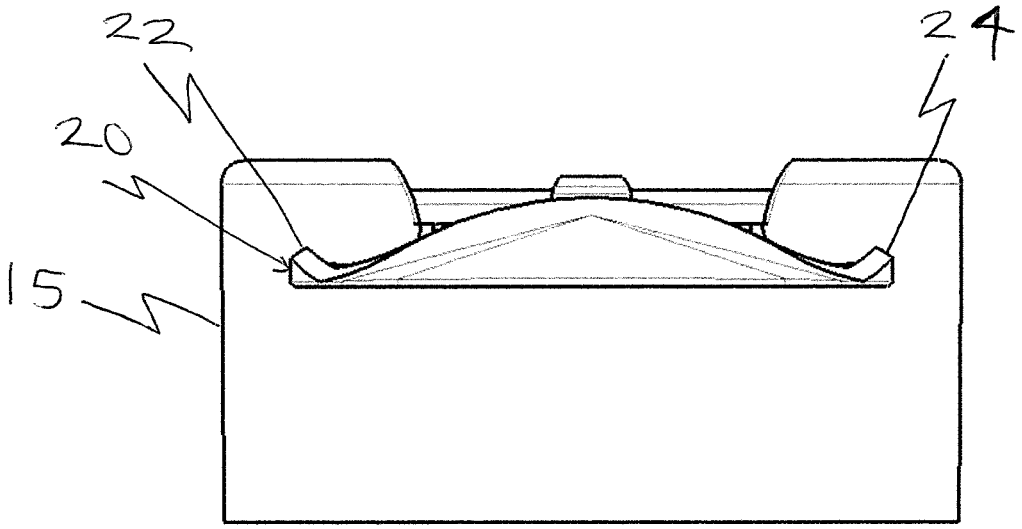
Figure 8:
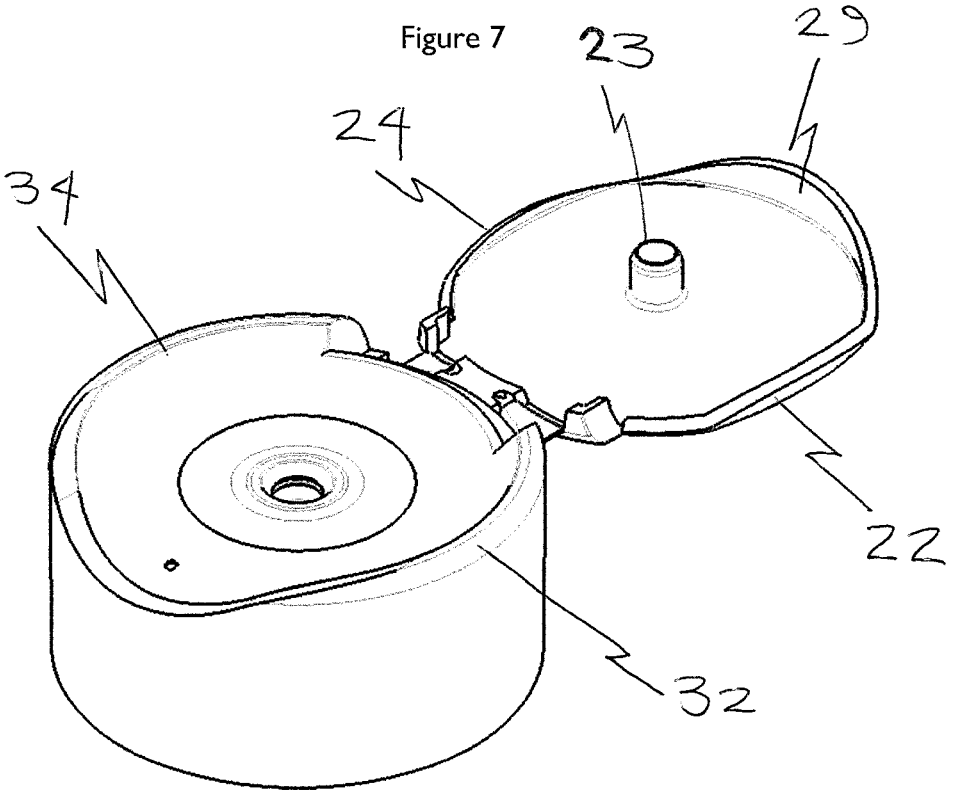
Figure 9:
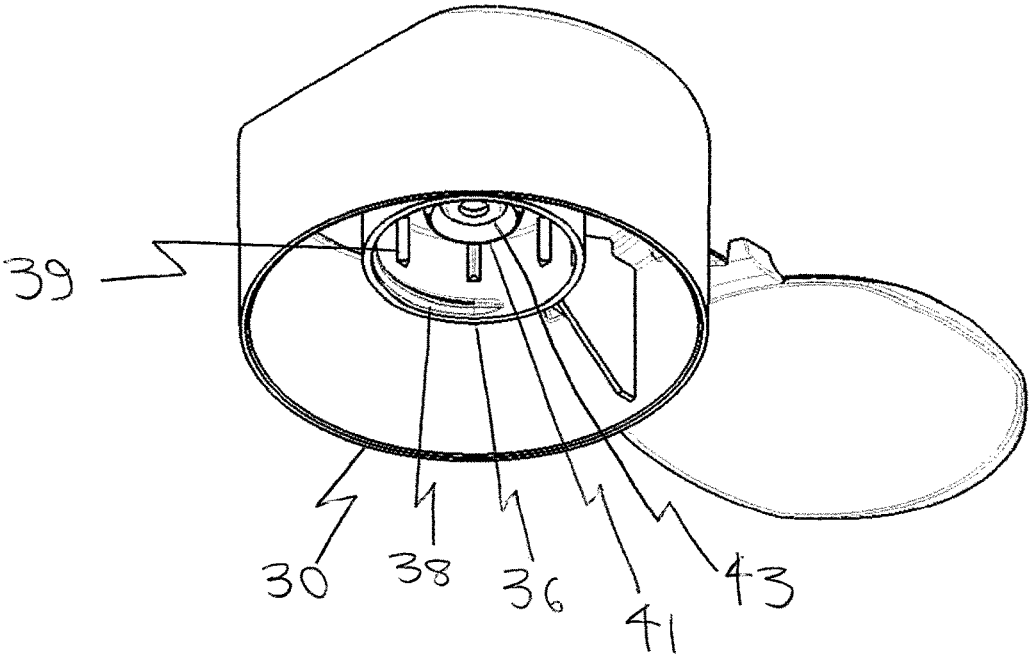
Figure 10:
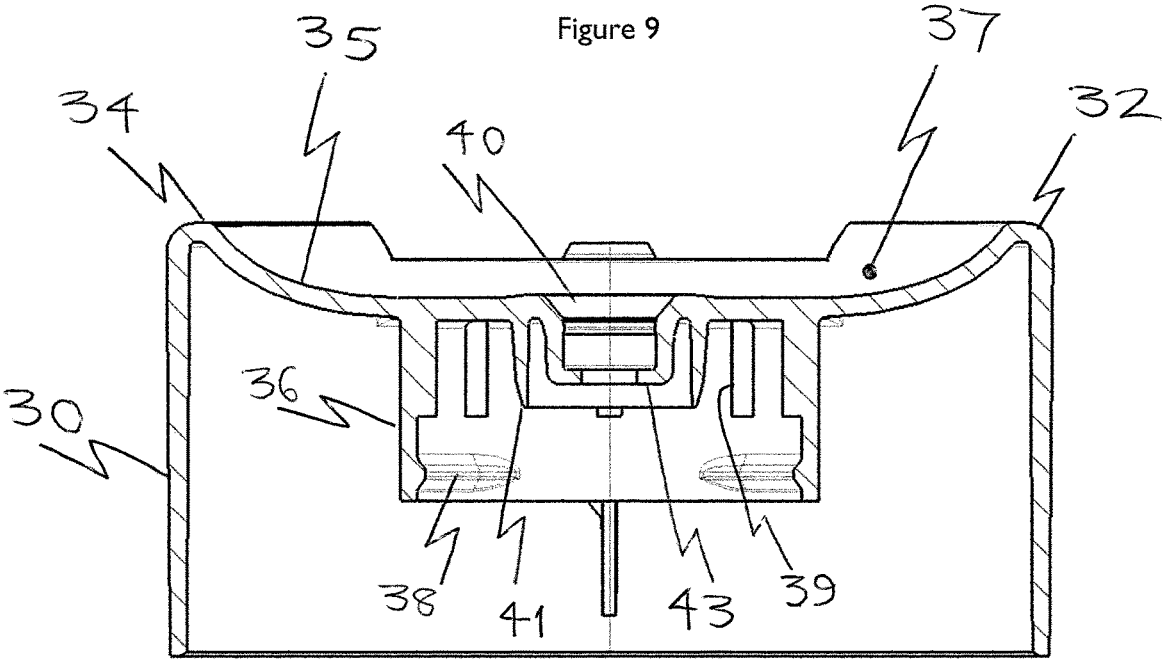
Figure 11:
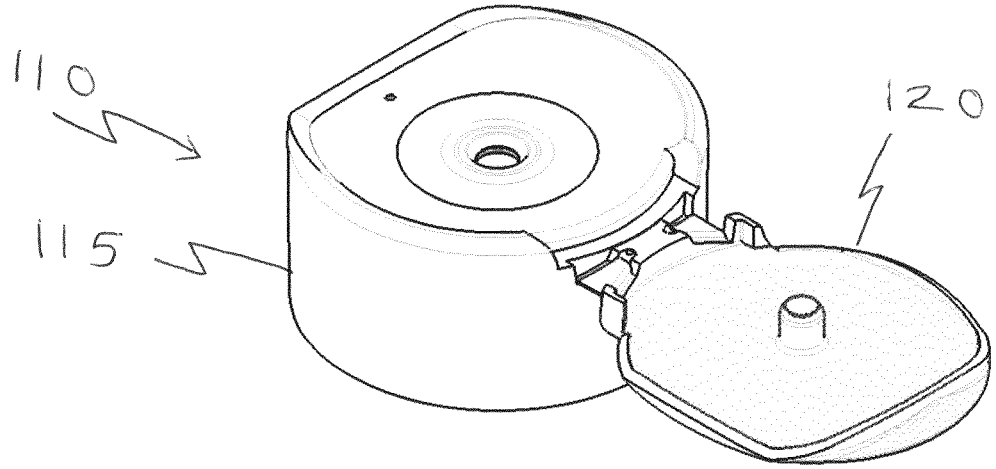
Figure 12:
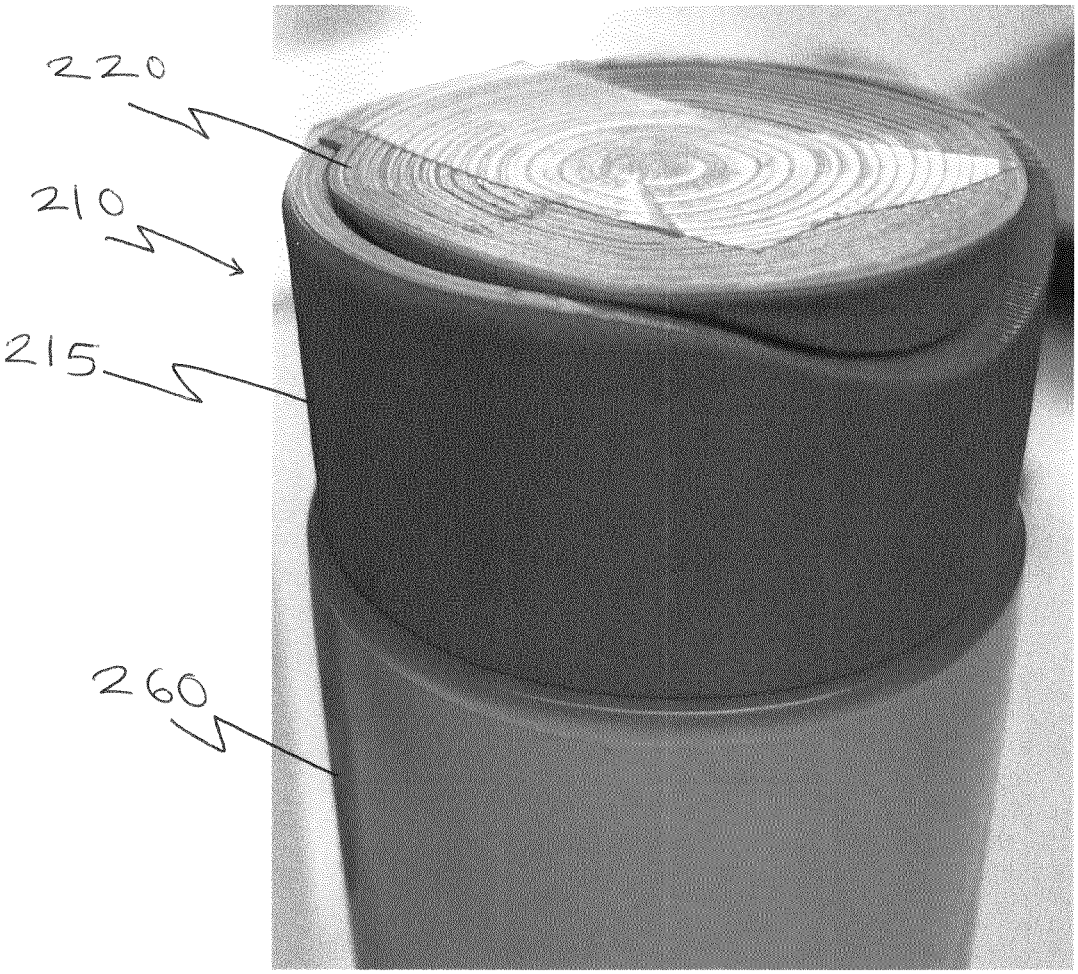
Figure 13:
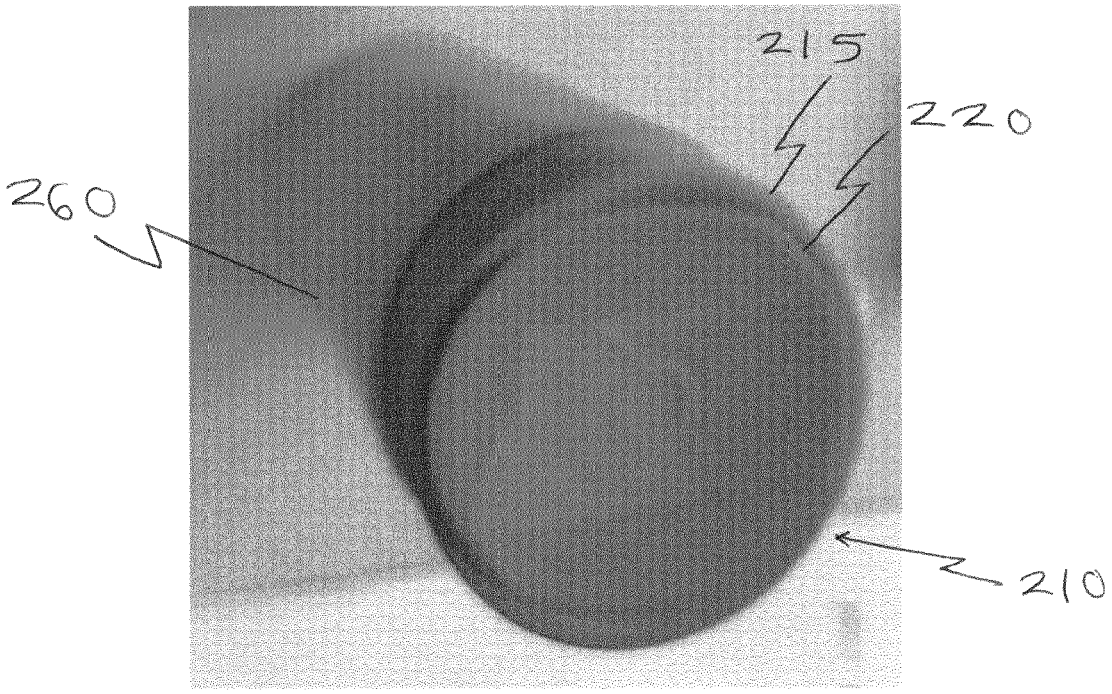
Figure 14:
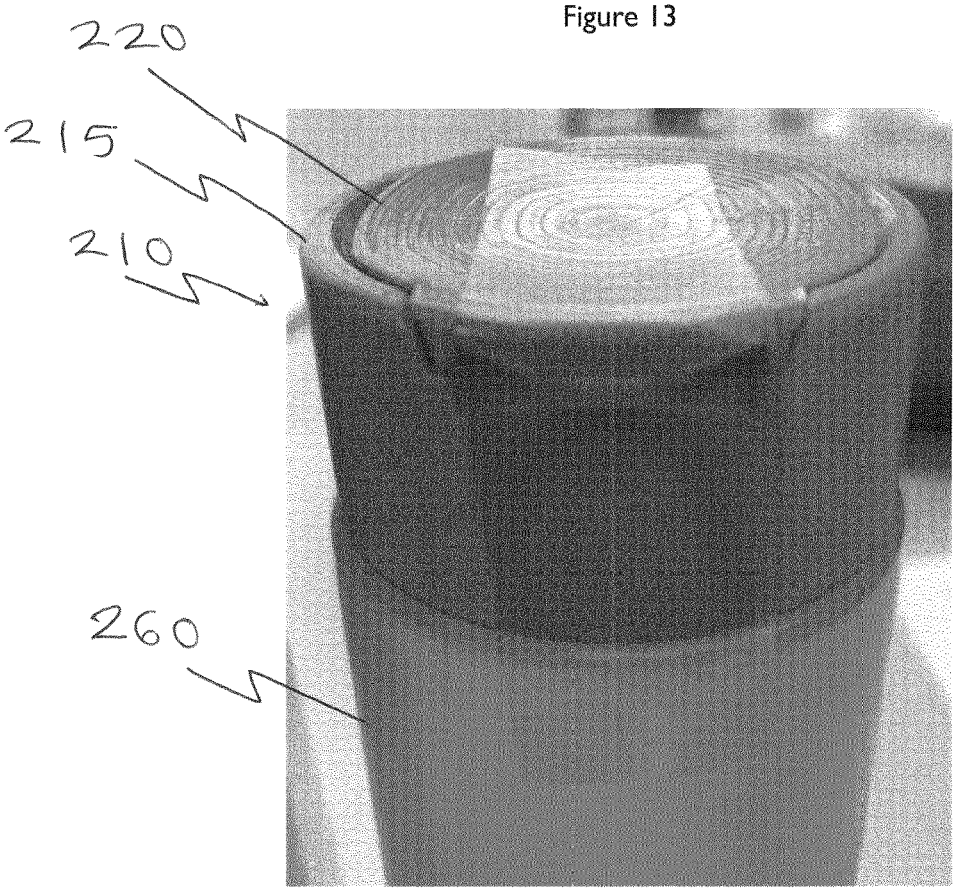
Figure 15:
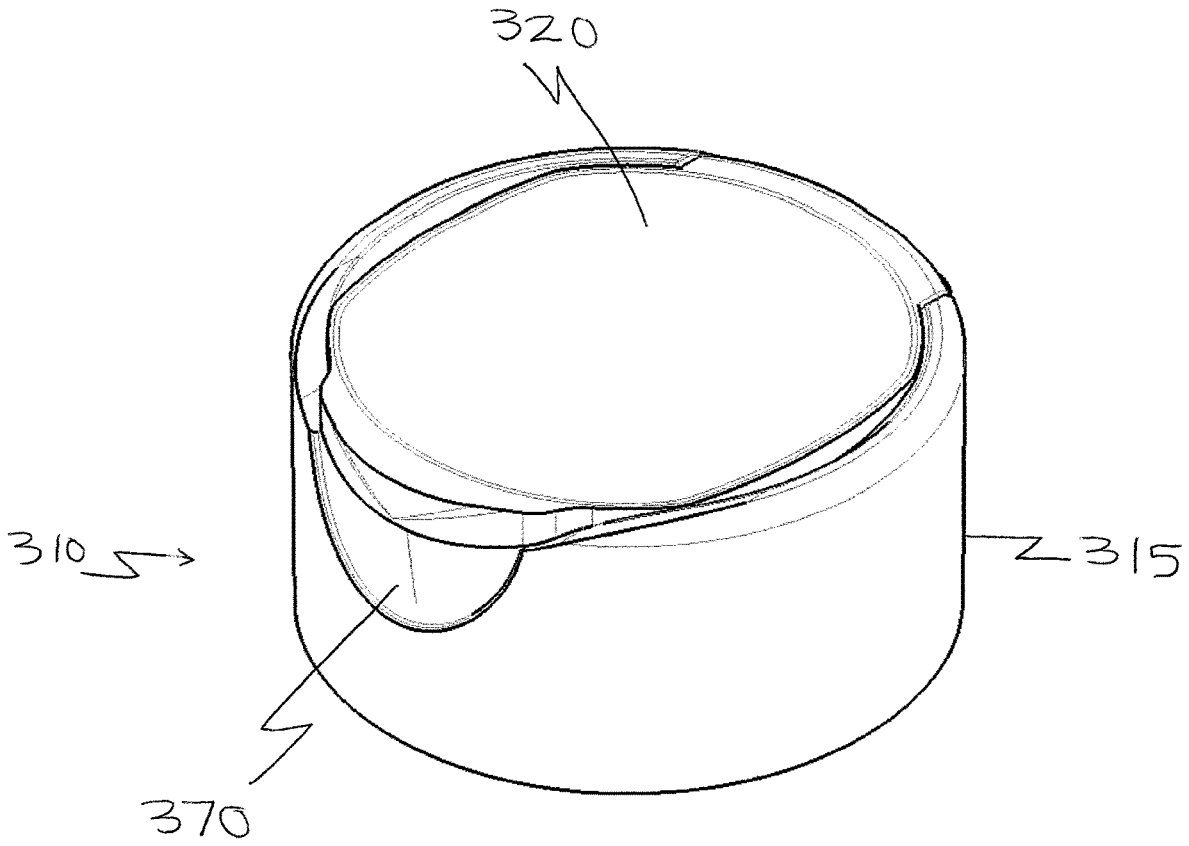
Figure 16:
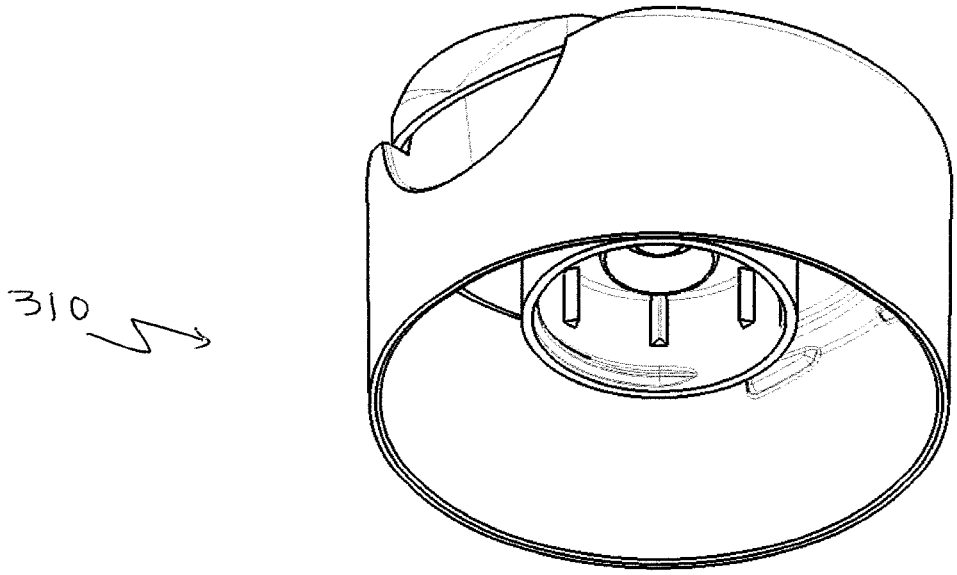
Figure 17:
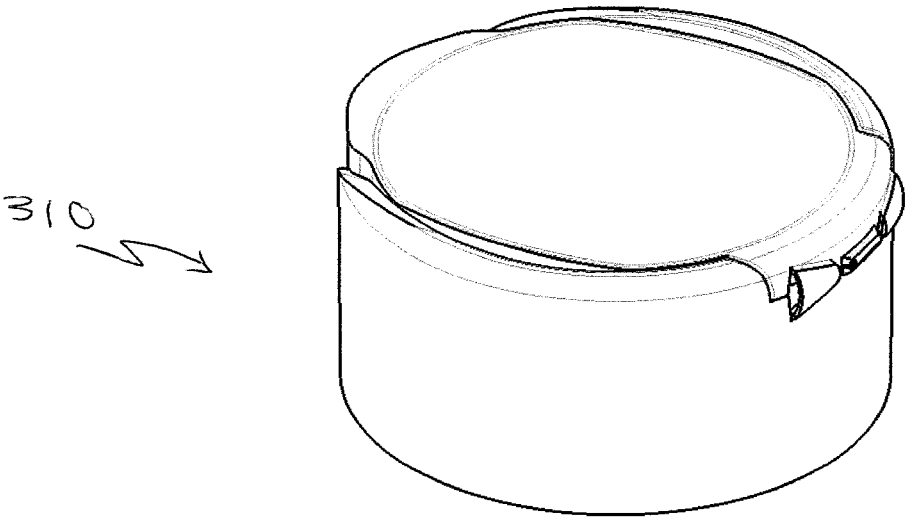
Figure 18:
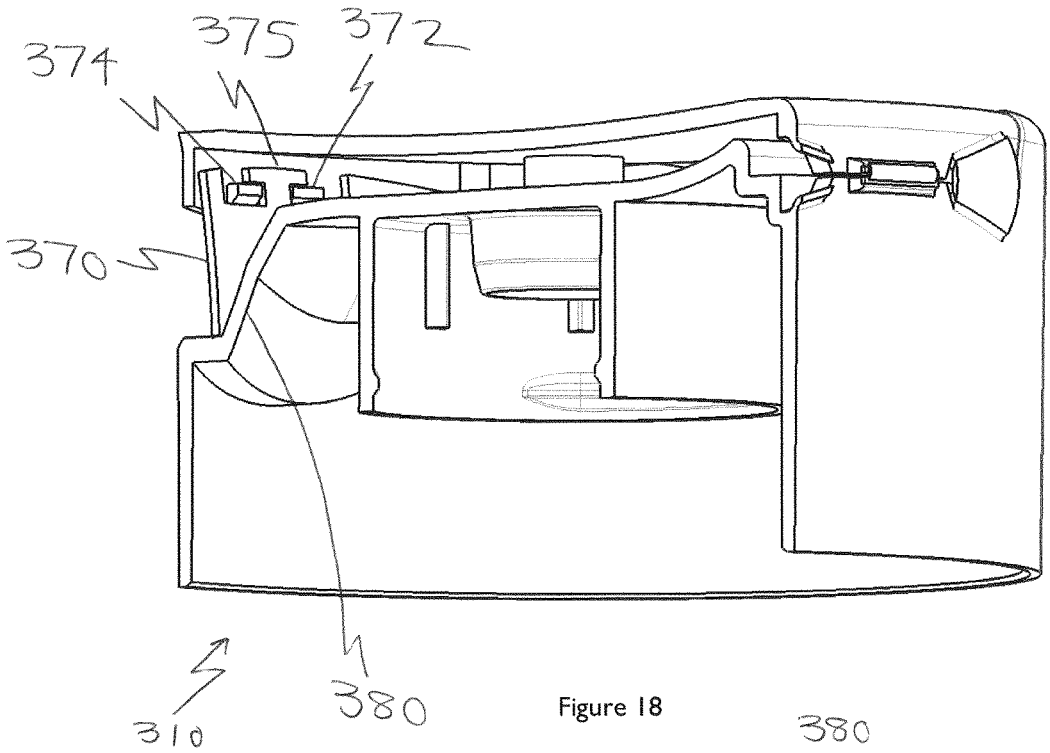
Figure 27:
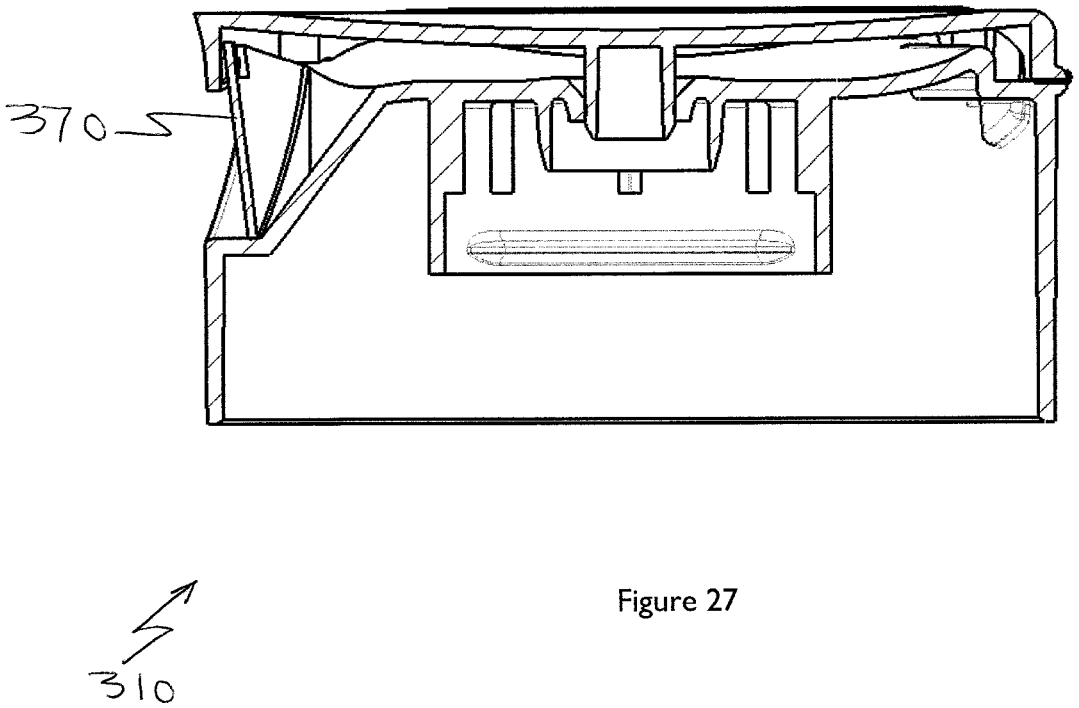
FIG. 27 is a section of the closure shown with the lid initially closed onto the base and with the transport lock engaged.

When the lid 320 is initially closed onto the base 315 the projections 380, 382 engage into the locking notches 372, 374, as shown best in FIGS. 18 and 27. In this embodiment the projections 380, 382 can deform the post 375 to enter the notches. In other embodiments, for example the panel could be formed in an inward position; then lid is then closed before the panel is pulled forwards to engage the projections in the notches.

With the projections engaged in the notches the lid cannot be lifted because of the post. This can be useful, for example as a transport lock to prevent accidental opening of the lid during transport/storage. Alternatively or additionally, this system could be useful for providing tamper-evidence and/or child-resistance.

Figure 28:
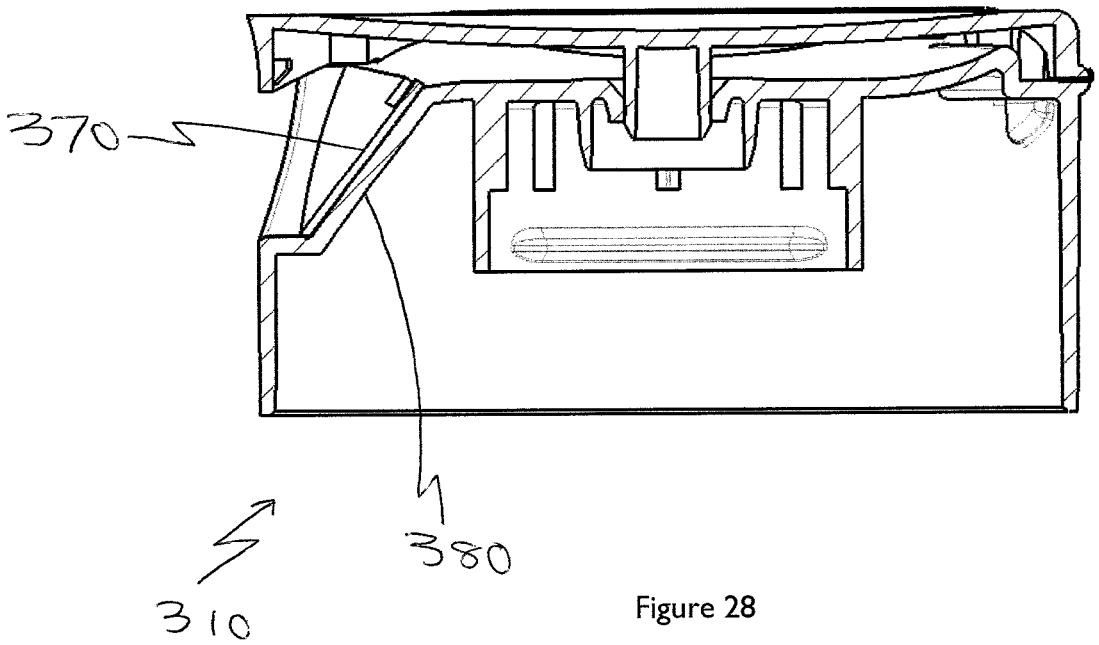
FIG. 28 shows the closure with the lock pressed inwards to disengage the lock.
Figure 29:
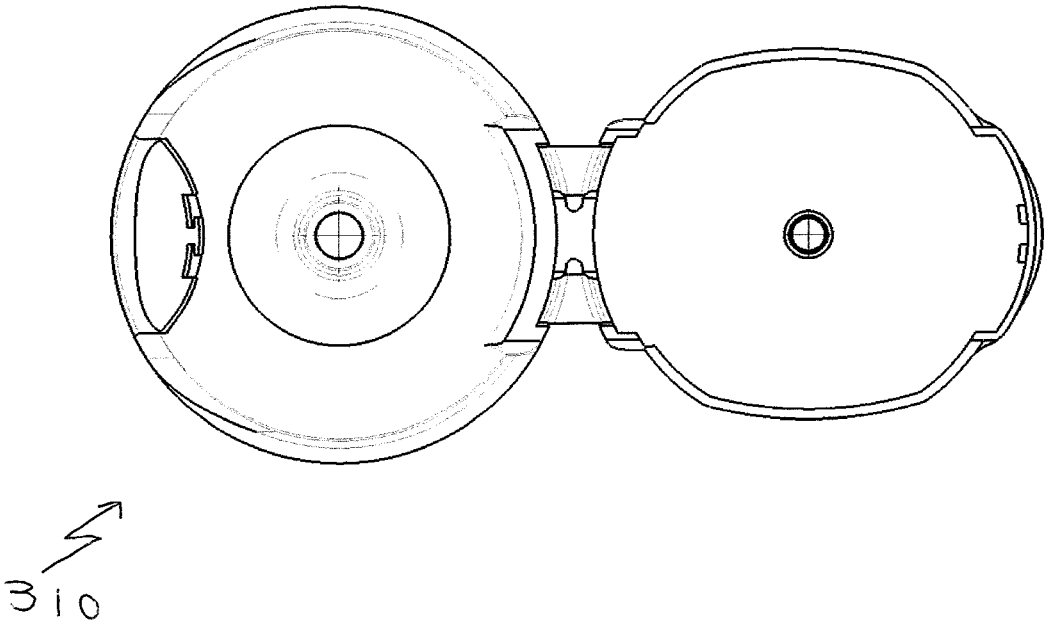
FIGS. 29 to 34 shows the closure with the lock disengaged and the lid flipped open.
Figure 30:
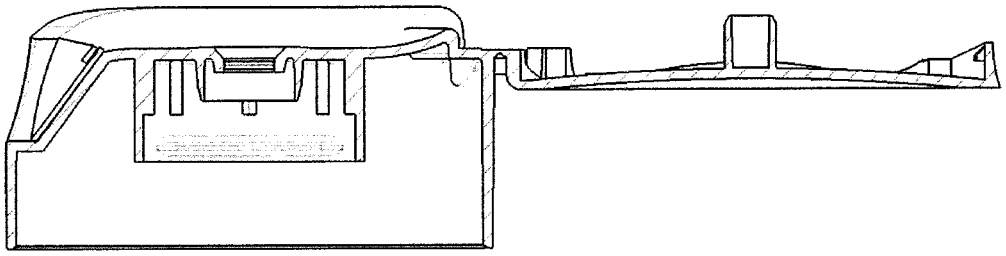
Figure 31:
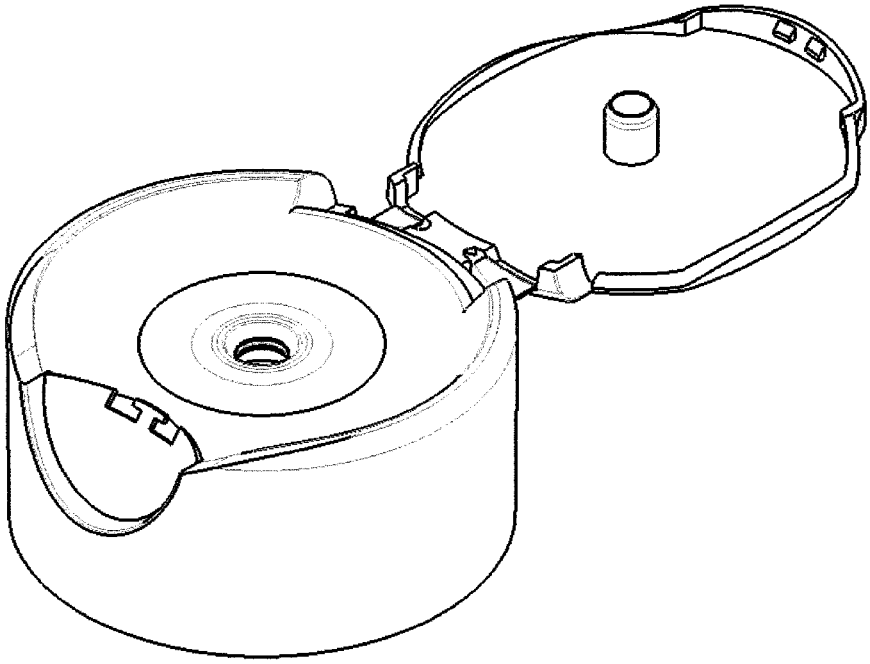
Figure 32:
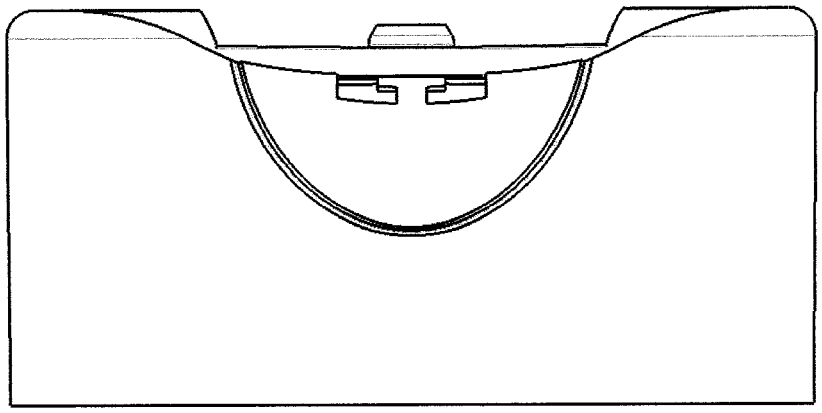
Figure 33:
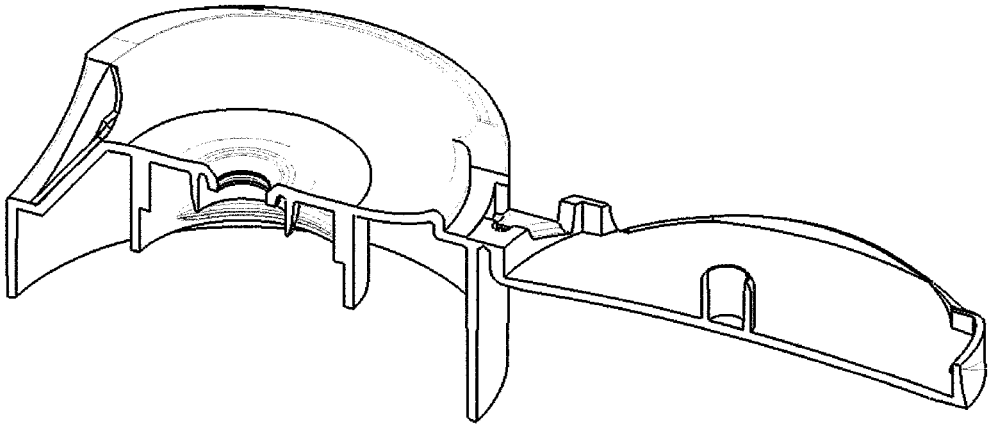
Figure 34:
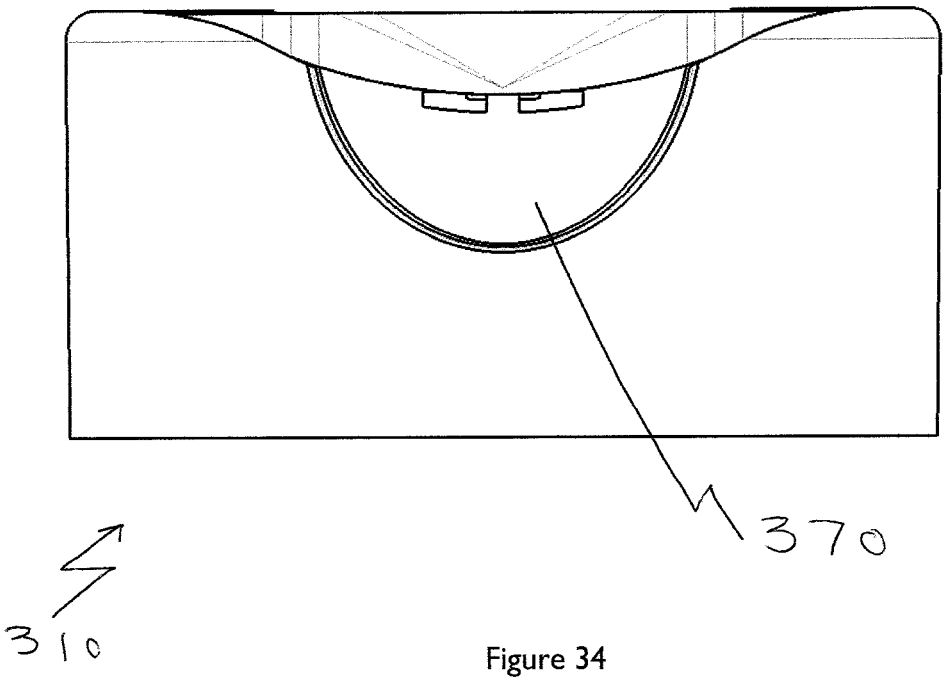
Figure 35:
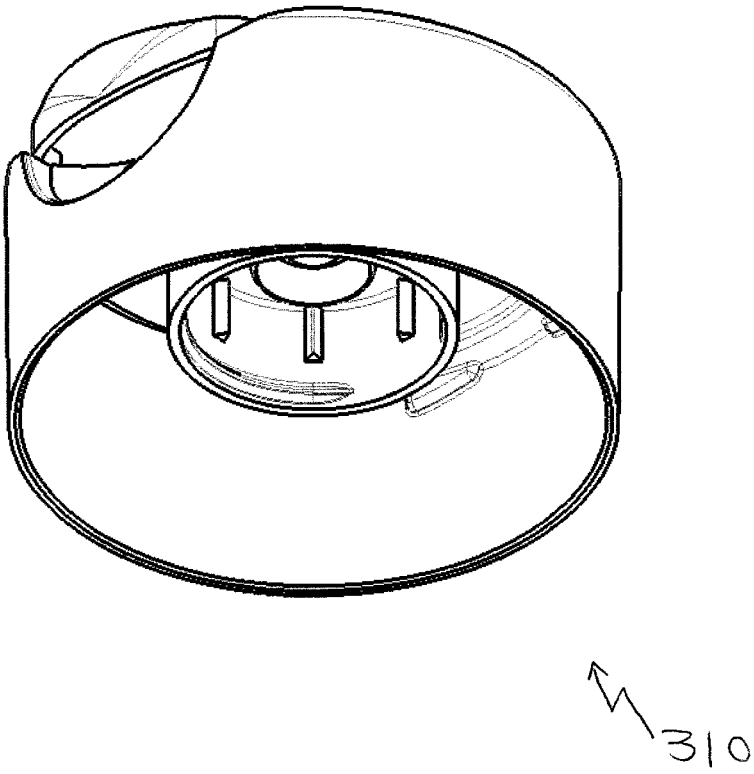
FIGS. 35 to 37 show the closure with the lid reclosed onto the base.
Figure 36:
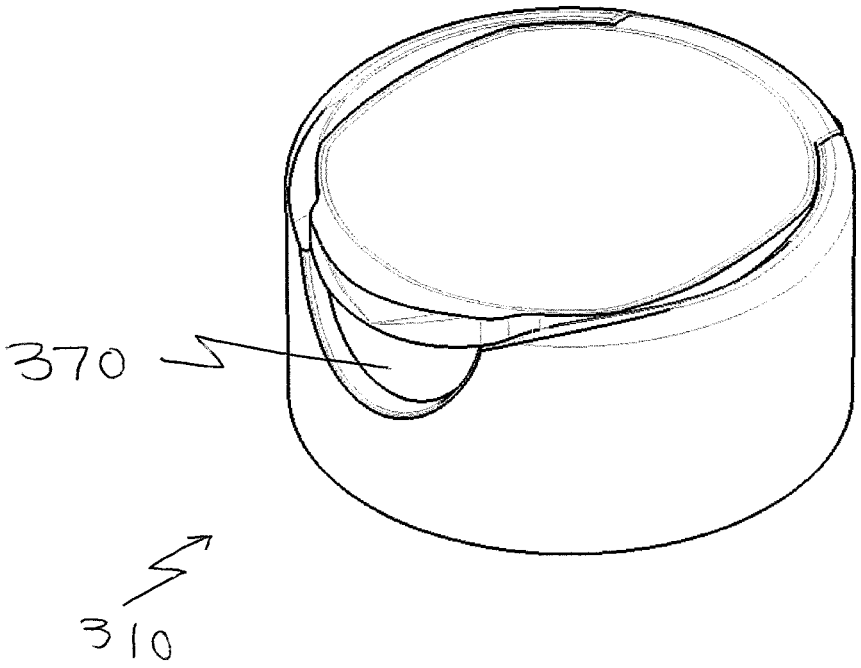
Figure 37:
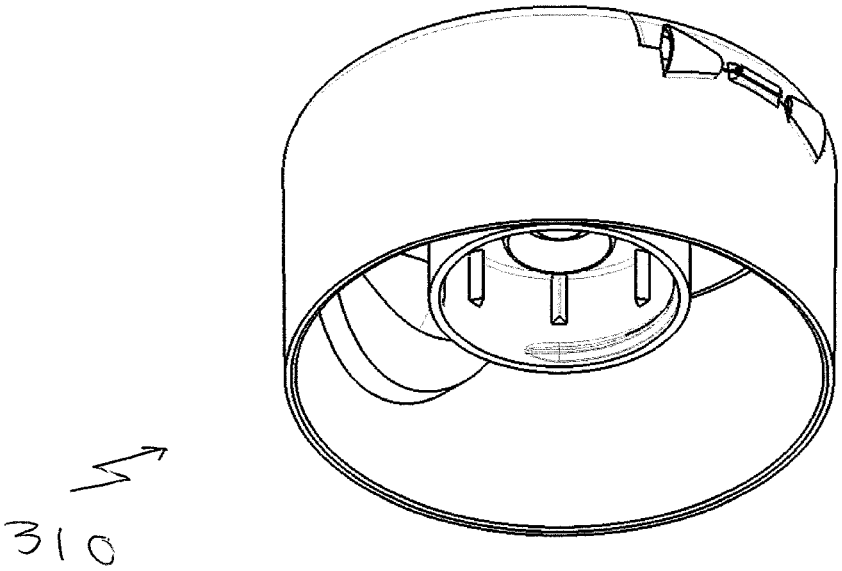

In order to be able to lift the lid the panel must be pushed/pressure inwards from the position shown in FIG. 27 to the position shown in FIG. 28 in which is rests against an inclined wall portion 380 that depends from the top deck. The lid can then be opened/lifted to the open position shown in FIGS. 29 to 33.

The lid is shown re-closed in FIGS. 34 to 37. The panel 370 remains in the inwards/unlocked (generally convex) position.

Figure 38:
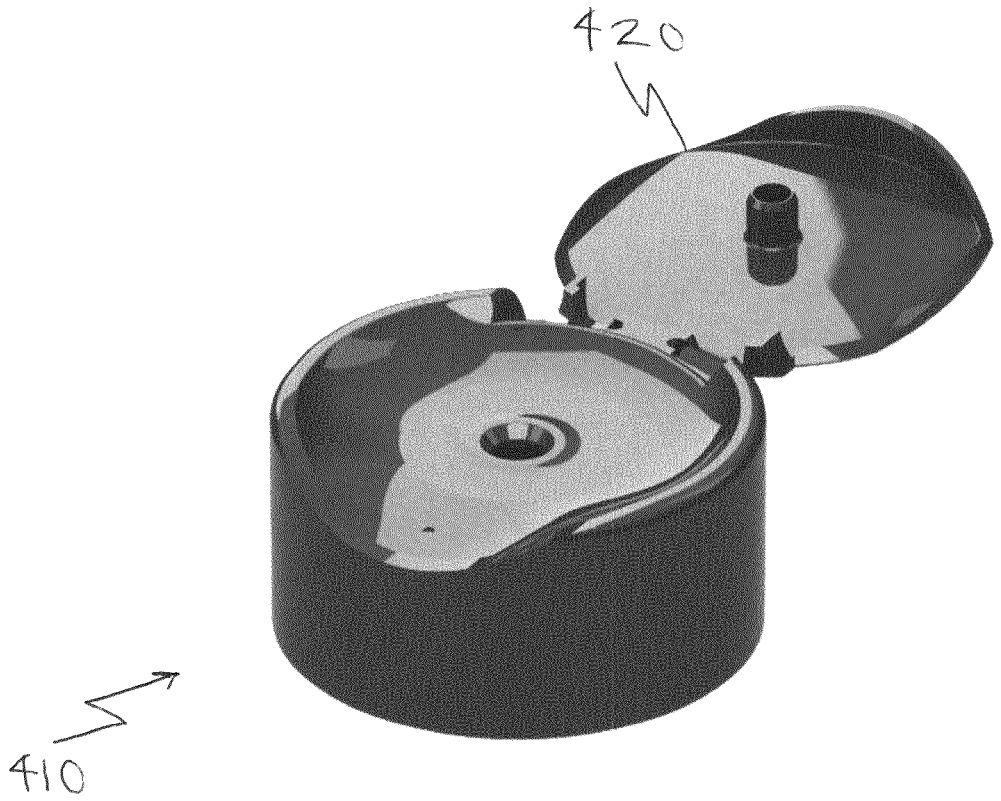
Figure 39:
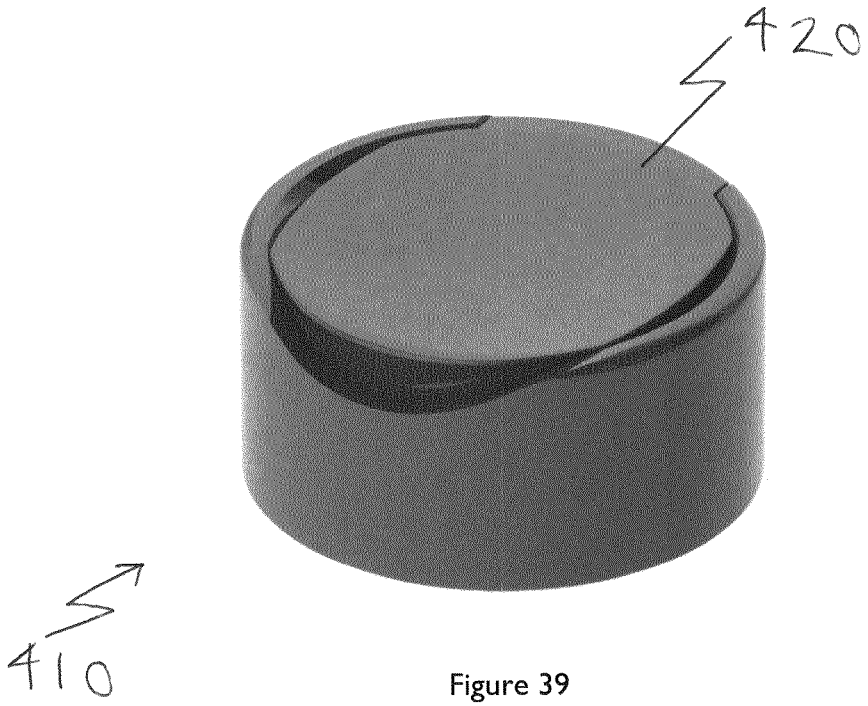
Figure 40:
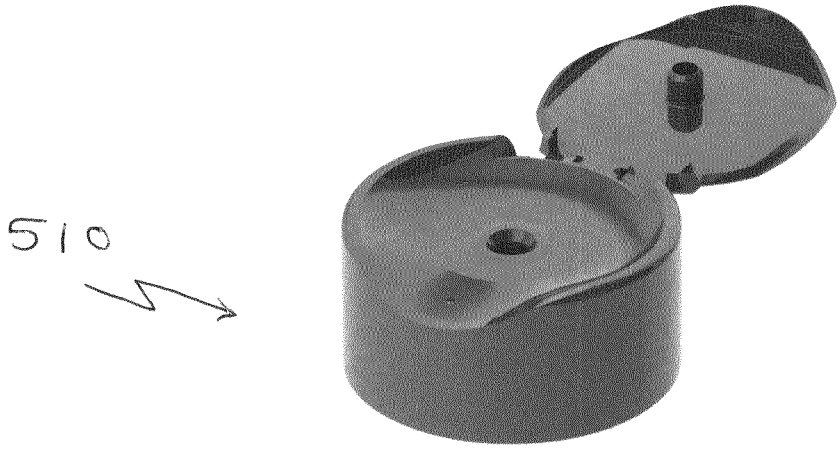
Figure 41:
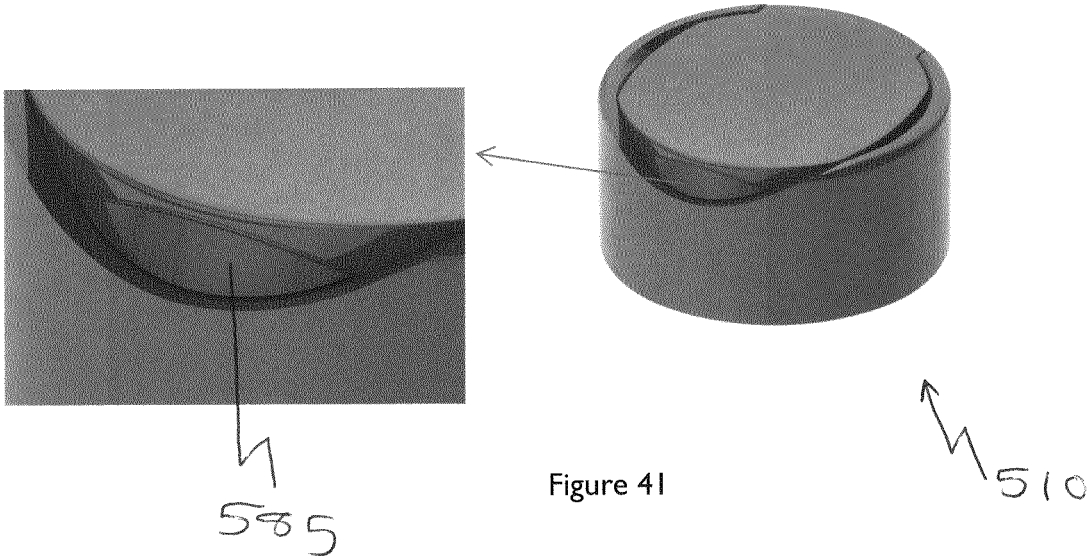

FIGS. 38 and 39 illustrate a closure 410 formed as a basic variant and with a lid shown in an open and closed position.
Push-on version
Lid covered from the body
Reduced weight
Improved for drop-test FIGS. 40 and 41 show a closure 510 formed in accordance with a further embodiment.
Push-on version
Lid covered from the body
Reduced weight
Improved for drop-test
Thumb recess flap—585

Figure 42:
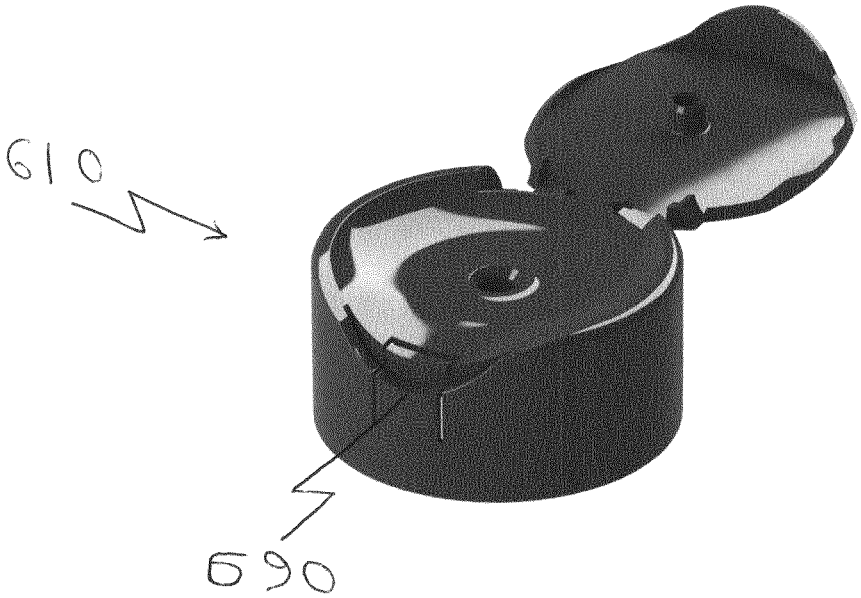
Figure 43:
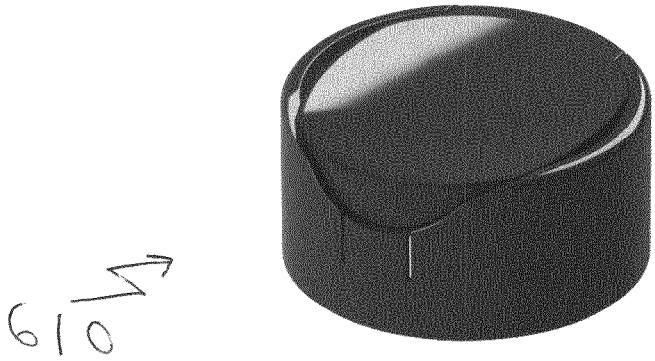

FIGS. 42 and 43 show a closure 610 formed according to a further embodiment.
Push-on version
Lid covered from the body
Reduced weight
Improved for drop-test
Hook-lock—690

Figure 44:
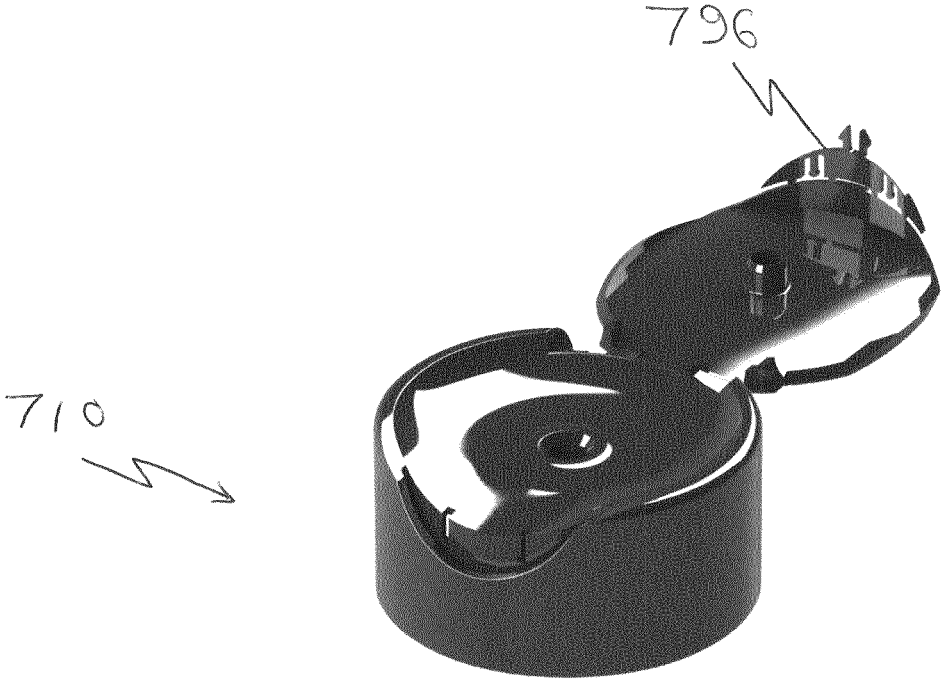
Figure 45:
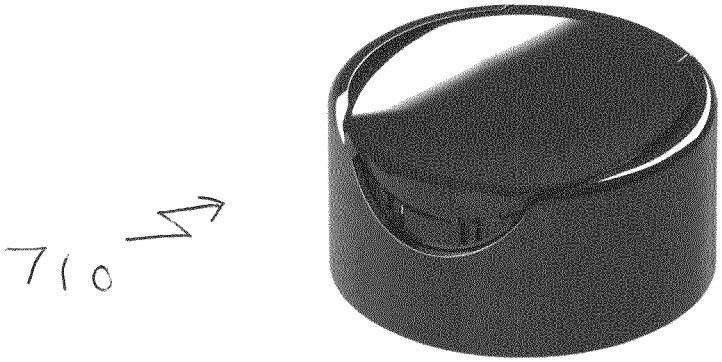

FIGS. 44 and 45 show a closure 710 formed according to a further embodiment.
Push-on version
Lid covered from the body
Reduced weight
Improved for drop-test
Tamper-evident band/tab with lock-segments I—796

Figure 46:
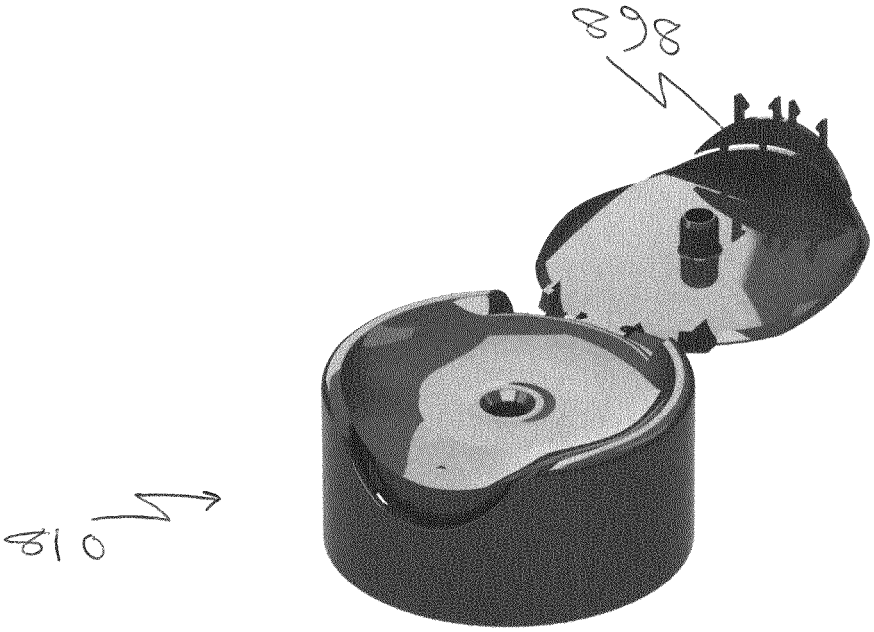
Figure 47:
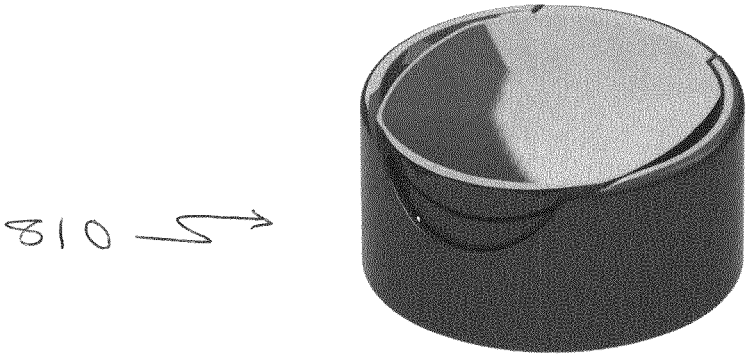

FIGS. 46 and 47 shows a closure 810 formed according to a further embodiment.

Push-on version
Lid covered from the body
Reduced weight
Improved for drop-test
Tamper-evident band/tab with lock-segments II—898

In FIGS. 44 to 47 the tamper-evident tab 796/898 is initially frangibly attached to the lid and includes hooks to engage in/on the base. Upon first opening the tab is torn/pulled away from the lid and retained by the base as evidence of opening.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A dispensing closure comprising a base and a lid, the base includes a sidewall closed at one end by a top deck including a dispensing orifice, the base and lid being joined by a hinge to allow the lid to move between closed and open positions with respect to the base whereby to close and open the dispensing orifice, at the periphery of the top deck the sidewall forms or provides a raised lip, in which the lid closes onto the top deck and is bounded by the lip and in which the lid is generally flush with the lip when in the closed position, in which the closure comprises a lid lock for preventing the lid being moved away from the closed position, the lid lock comprising a bi-stable locking portion movable between a locked position in which lid cannot be moved to the open position and an unlocked position in which the lid can be moved to the open position, in which in the locked position the locking portion is generally concave and in the unlocked position the locking portion is generally convex.

2. A closure as claimed in claim 1, in which the top deck is dished.

3. A closure as claimed in claim 1, in which the lip is formed at the intersection between the sidewall and the top deck.

4. A closure as claimed in claim 1, in which the sidewall lip comprises two arc portions separated at a front of the closure by a lifting recess and at the back of the closure by a hinge recess.

5. A closure as claimed in claim 1, in which the locking portion comprises a flap, beak or panel.

6. A closure as claimed in claim 1, in which the movable locking portion is provided on or by the base.

7. A closure as claimed in claim 1, in which the sidewall includes a lifting recess which exposes part of the lid.

8. A closure as claimed in claim 7, in which the lifting recess is generally opposite the hinge.

9. A closure as claimed in claim 1, in which the deck has a dispensing orifice.

10. A closure as claimed in claim 1, in which an upper surface of the lid is generally flat.

11. A closure as claimed in claim 1, in which the hinge is a butterfly hinge.

12. A closure as claimed in claim 1, in which the skirt generally cylindrical.

13. A closure as claimed in claim 12, in which the section of the skirt is generally circular or generally oval.

14. A closure as claimed in claim 1, in which the lid has an overhang for allowing it to be lifted.

15. A closure as claimed in claim 1, in which the base is engageable on a container neck using screw threads, or using snap fitting.

16. A closure as claimed in claim 1, in which in an as-moulded condition the locking portion is in the locked position.

17. A closure as claimed in claim 1 in combination with a container.

18. A closure in combination with a container as claimed in claim 17, in which the container is a tube.

19. A closure as claimed in claim 18, in which at the back of the base, a hinge notch is provided, and in the hinge has two opposed lateral trapezoidal link and a central main hinge portion, in which at one end the hinge the straps and central main hinge portion connect to the base in the hinge notch, at the other end the hinge the straps and central main hinge portion connect to an arcuate portion at the rear of the lid, and in which when the lid is closed the portion sits in the hinge notch.

20. A closure comprises a base and a lid, the base and lid are joined by a hinge which allows the lid to move between a closed position and an open position, the base comprises a generally cylindrical sidewall with a generally circular section, at one end of the sidewall is a generally circular top deck, the top deck has a central dispensing orifice, the top deck is dished, and the top of the sidewall provides two arcuate raised ridges which means that the intersection between the periphery of the top deck and the sidewall is taller with respect to the centre of the top deck, the lid has a non-circular shape including two lateral sides, the two lateral sides of the lid are radially inwards of, the ridges when the lid closes onto the base.

* * * * *